US006983565B2

(12) United States Patent
Berry et al.

(10) Patent No.: US 6,983,565 B2
(45) Date of Patent: Jan. 10, 2006

(54) AIR HEATED, FLEXIBLE DOOR PANEL

(75) Inventors: Curtis L. Berry, Williamsport, MD (US); William B. Nichols, Chambersburg, PA (US)

(73) Assignee: Jamison Door Company, Hagerstown, MD (US)

( * ) Notice: Subject to any disclaimer, the term of this patent is extended or adjusted under 35 U.S.C. 154(b) by 17 days.

(21) Appl. No.: 10/339,822

(22) Filed: Jan. 10, 2003

(65) Prior Publication Data

US 2004/0134128 A1 Jul. 15, 2004

(51) Int. Cl.
*E06B 3/46* (2006.01)

(52) U.S. Cl. ..... 49/370; 49/118; 62/275

(58) Field of Classification Search ..... 49/116, 49/118, 120, 366, 370, 409, 404, 475.1, 478.1, 49/501; 62/273, 275, 265
See application file for complete search history.

(56) References Cited

U.S. PATENT DOCUMENTS 3,215,058 A * 11/1965 Anderson ..... 454/192
3,254,503 A * 6/1966 Rundell ..... 62/275
3,449,925 A * 6/1969 Barroero ..... 62/275
3,675,377 A 7/1972 Suter
3,859,502 A * 1/1975 Heaney ..... 219/218
3,869,873 A * 3/1975 Thomas ..... 62/275
4,084,347 A 4/1978 Brown
4,127,765 A * 11/1978 Heaney ..... 219/218
4,223,482 A * 9/1980 Barroero et al. ..... 49/386
4,382,461 A * 5/1983 Schenker ..... 160/329
4,516,482 A * 5/1985 Smith ..... 454/191
4,588,235 A * 5/1986 Barroero ..... 312/138.1
4,619,975 A 10/1986 Matzner et al.
4,831,780 A * 5/1989 Bockwinkel ..... 49/504
4,855,567 A * 8/1989 Mueller ..... 219/218
4,941,289 A * 7/1990 Rolek ..... 49/504
4,950,869 A 8/1990 Mueller
5,035,085 A * 7/1991 Mamelson et al. ..... 49/504
5,111,618 A * 5/1992 Kaspar et al. ..... 49/501
5,129,184 A * 7/1992 Fish ..... 49/478.1
5,143,137 A * 9/1992 West ..... 160/199
5,203,175 A * 4/1993 Farrey et al. ..... 62/82
5,255,473 A * 10/1993 Kaspar et al. ..... 49/501
5,271,236 A * 12/1993 Sweetser ..... 62/155
5,309,680 A * 5/1994 Kiel ..... 49/478.1
5,329,781 A * 7/1994 Farrey et al. ..... 62/82
5,418,342 A * 5/1995 Miller ..... 200/61.43
5,584,191 A * 12/1996 Kwon ..... 62/417
5,729,989 A * 3/1998 Sunaga et al. ..... 62/126
5,924,298 A * 7/1999 Yoo ..... 62/153
5,927,015 A * 7/1999 Ghosn et al. ..... 49/291
5,927,095 A * 7/1999 Lee ..... 62/275
5,975,664 A * 11/1999 Banicevic et al. ..... 312/405

(Continued)

*Primary Examiner*—Gregory J. Strimbu
(74) *Attorney, Agent, or Firm*—Frost Brown Todd LLC

(57) ABSTRACT

A door system for a cold storage locker has increased resistance to damage by including resilient door panels that flex when hit by a forklift. A high degree of insulation is achieved by the choice and thickness of the resilient foams therein. Also, the resilient door panels are magnetically attracted to a gasket seal on a doorframe to provide an affirmative seal. Active magnetic control may enhance the attraction or repulsion of the door panel. Frost control is realized by warming air from the cold storage locker and passing it through air channels in the door panel proximate to the gasket seal and down an astragal interface between door panels.

25 Claims, 19 Drawing Sheets

U.S. PATENT DOCUMENTS 6,056,383 A * 5/2000 Banicevic et al. ..... 312/406
6,144,017 A * 11/2000 Millett et al. ..... 219/522
6,152,208 A 11/2000 Kalempa et al.
6,225,904 B1 * 5/2001 Jaffe et al. ..... 340/545.6
6,226,995 B1 5/2001 Kalempa et al.
6,301,913 B1 * 10/2001 Schulak et al. ..... 62/248
6,330,763 B1 12/2001 Kern et al.
6,360,487 B1 3/2002 Kern et al.
6,408,636 B1 * 6/2002 Backes et al. ..... 62/275

* cited by examiner

AIR HEATED, FLEXIBLE DOOR PANEL

FIELD OF THE INVENTION

The present invention relates, in general, to top-supported doors, and more particularly to resilient doors suitable for cold storage rooms.

BACKGROUND OF THE INVENTION

So-called horizontal sliding doors include at least one door panel that is suspended by a carriage that travels along an overhead track. The door panel may be manually or automatically moved from a blocking position to an unblocking position along the overhead track. Wider door openings are often spanned by having two bi-parting door panels. In some instances, the amount of overhead track required to extend beyond the door opening is reduced by having the door panel vertically divided into a number of coupled (e.g., over-lapped, hinged) vertically-separated leaves that take up less horizontal space when moved to the unblocking position.

Cold storage lockers are often accessed through a door opening closed by a sliding door. The panels for this purpose are typically transparent vinyl sheets, minimally insulated flexible panels or foam filled rigid panels. The transparent vinyl sheets are selected to reduce the likelihood of damage to the door. In particular, such doors are used in institutional (e.g., warehouse) setting wherein palletized cargo is moved in and out of a cold storage locker by forklift. Another advantage to these doors is that forklift operators can see what is on the other side of the door before opening the door. Although providing damage resistance, these types of panels have a very low insulation value and are too flexible to provide an effective air seal between the environments on either side of the opening. Because of the properties of the material, the transparent vinyl sheets may develop a warp that prevents a good seal. Air pressure differentials will cause leakage due to the lack of a compressive seal between the door panels and the doorframe. This will allow a significant amount of warm moist air to enter the cold storage locker and/or refrigerated air to be lost into an unrefrigerated space. Consequently, such door systems are less efficient to operate and can suffer from ice accumulation in the cold storage locker.

Rigid door panels are often used, especially in the United States, in order to reduce the operating costs of a cold storage locker. The rigid panel provides a consistent surface to seal to the doorframe. The thickness of the rigid door panel is selected to provide a specific amount of insulation. While these rigid door panels provide an effective closure, impact by a forklift can cause damage to the door system that would make them inoperative and limit access to the cold storage locker.

Attempts have been made to provide a damage resistant door panel for a sliding door system that also provides sufficient insulation. Resilient door panels have been suggested which have sufficient thickness to insulate like a rigid door panel, but yield to a degree when impacted by a forklift. While the panel itself achieves a degree of insulation, the insulation capability of the overall door system suffers from poor sealing between panels and poor sealing between a panel and the doorframe. Specifically, the stiffness of each door panel tends to be less than that of a rigid door panel, and thus presents less of a compressive contact to a doorframe gasket to achieve a seal. To achieve a seal with this type of panel different devices have been tried. Interlocking gaskets can be damaged as the door is pulled away from the casing. In addition they require rigid plates in the door panel for attachment which makes the panel heavier and less resilient. Others have used wall mounted guide tracks to pull the middle of the door back. This adds additional cost, makes installation more difficult and does not address sealing of the entire edge of the door; it only forces a seal at the top, bottom and middle. Because of the application it is difficult to add electrical wiring to the panel because it is flexible and could be torn open and damage or expose wiring. Condensation control on the panel is typically done using resistance wire but that will does not work because of the panel design. Others have tried using external heaters and blowers that are an inefficient means of controlling the condensation.

Consequently, a significant need exists for an improved door system that is suitable for institutional cold storage lockers by providing significant thermal insulation, efficient condensation control yet being resistant to damage from impacts.

BRIEF SUMMARY OF THE INVENTION

The invention overcomes the above-noted and other deficiencies of the prior art by providing a resilient door panel for a sliding door system that achieves a good seal to a doorframe by attracting the door panel. The compressive seal is achieved without reliance upon a rigid back surface of the door panel, or upon the weight of the door panel. Therefore, materials and assembly methods may be selected for a desired resilience, insulation and economy of manufacture.

In one particular aspect of the invention, a resilient door panel is used in a closure system. A seal formed between a doorframe and the door panel is effectively achieved by attracting the door panel to the doorframe either pneumatically or magnetically. Eliminating the need for rigid components in the door panel enables the use of numerous manufacturing approaches, such as bagged foam sheets, bagged poured foam door panels, and even unbagged foam doors that self-skin. Thereby, the manufacturing steps are greatly reduced and thus the cost of each door panel.

In another aspect of the invention, an approach to keeping the door seals free of ice is provided that is particularly suitable to resilient door panels. In particular, since the resilient door panel readily flexes, it is desirable to eliminate electrical wiring in the door panel that may be damaged during impact. Thus, heating of a door panel periphery by electrical resistive heating is eliminated;

however, it is desirable to ensure that the seals between the doorframe/door panel, door panel/floor and door panel/door panel does not accumulate frost. Otherwise, the door system drive mechanism or the seal may be damaged in attempting to overcome a frozen seal. The door system may fail to open altogether if sufficiently stuck to stall the drive mechanism. Other problems associated with frost accumulation include achieving a poor seal with the resulting economic inefficiencies and safety and appearance issues related to accumulating ice and moisture.

In yet a further aspect of the invention, an automated door system includes a door position sensor that senses the door panel being in a closed position with a periphery of a door panel registered to a doorframe. A door positioning system responds to the door position sensor indicating that the door has been impacted by resetting the door panel to an open position, thereby mitigating possible damage to the door system.

Thus, in another aspect of the invention, a frost control system is incorporated into the closure system to warm the refrigerated air from the cold storage locker, which advantageously tends to contain less water vapor than air from the unrefrigerated side of the door. The warmed air is directed through an air passage to proximity of a periphery of the door panel and its seal to the doorframe. In particular versions of the invention, this air passage includes passing inside of the door panel.

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION OF THE INVENTION

Figure 1:
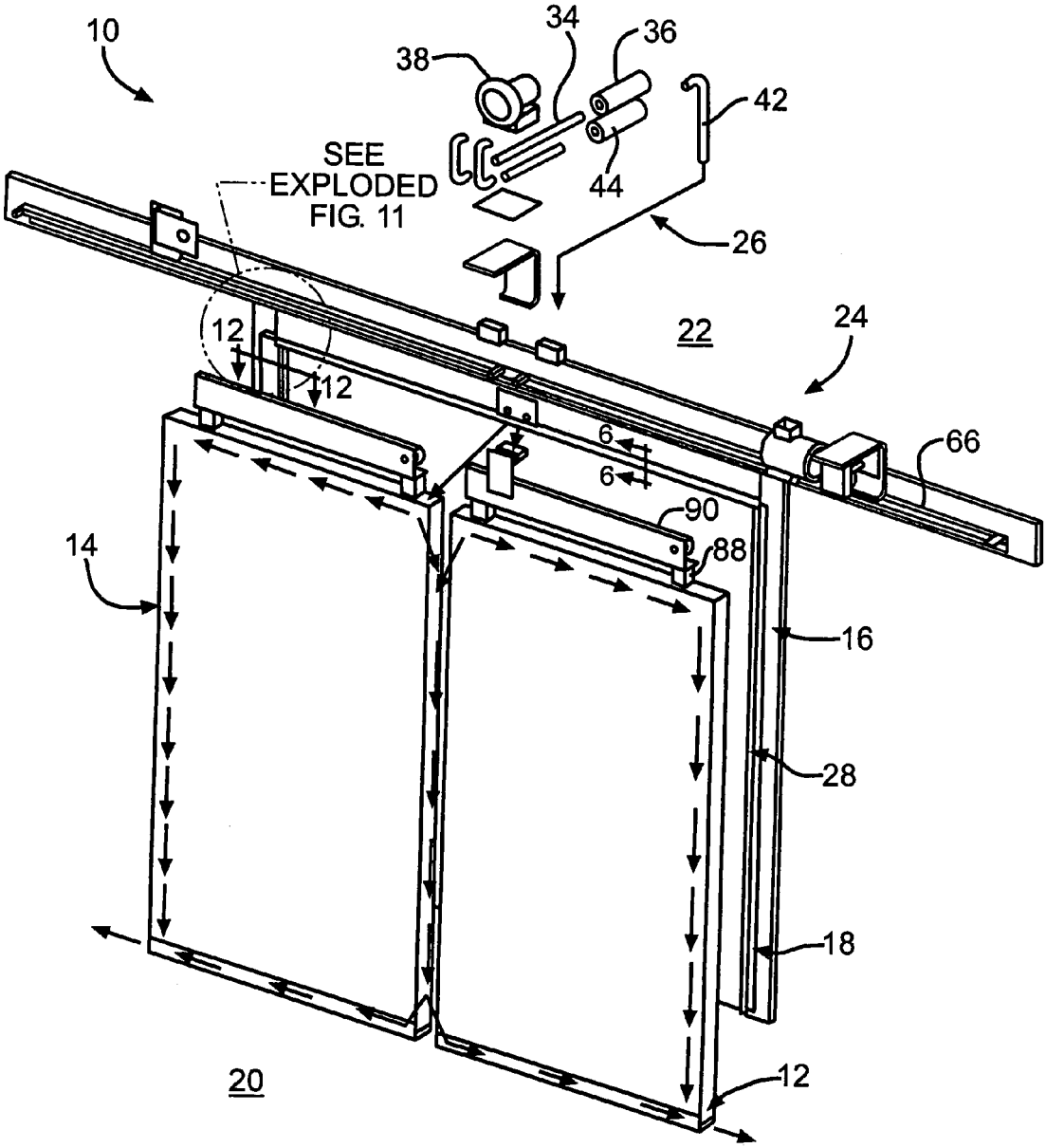
FIG. 1 is front exploded perspective view of a damage resistant door system for an institutional cold storage locker.
Figure 2:
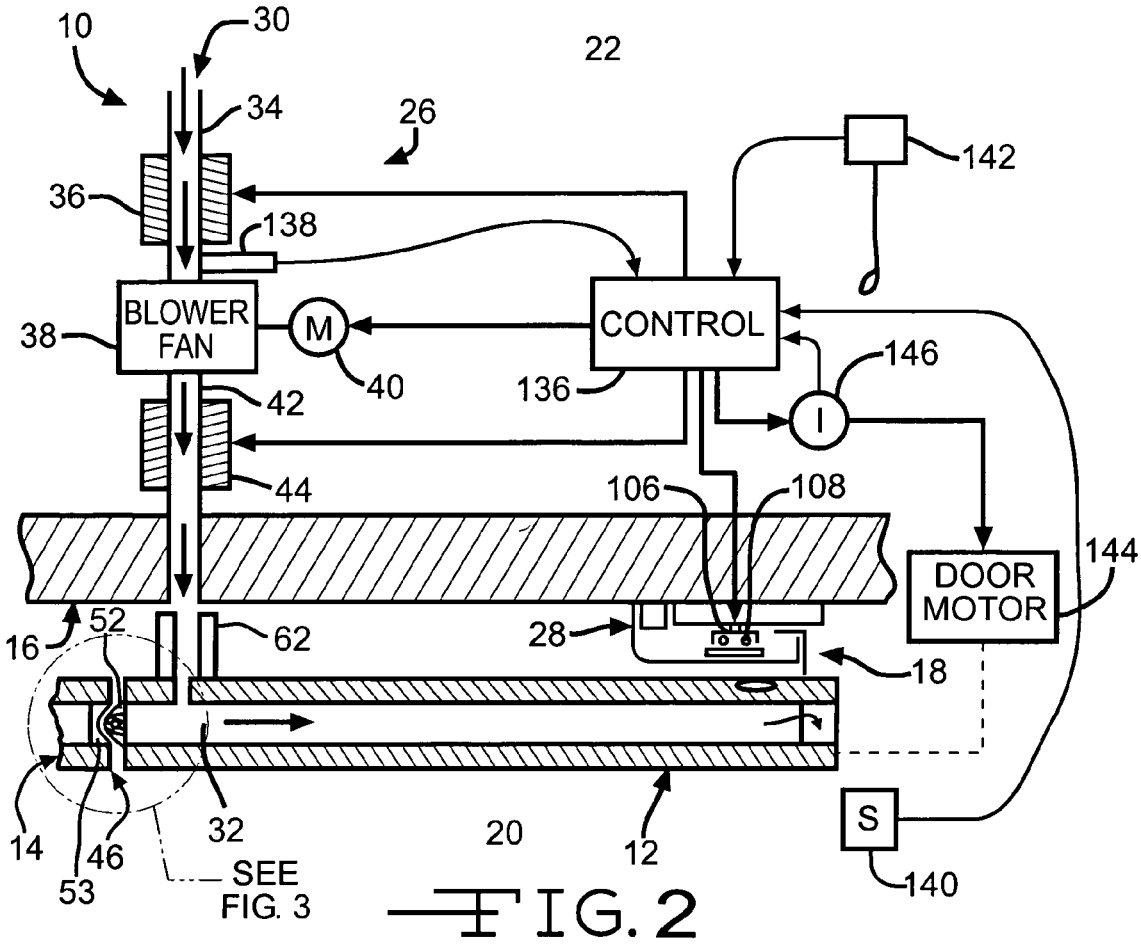
FIG. 2 is a diagrammatic view of a frost resistant sealing system of the door system of FIG. 1.
Figure 3:
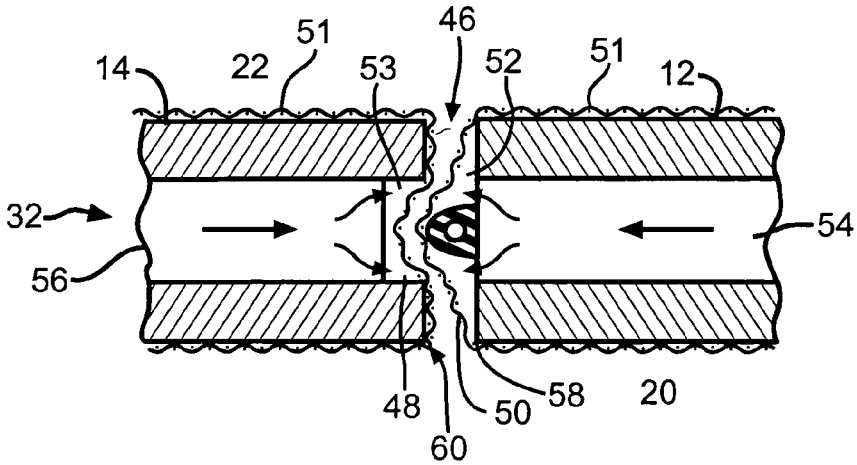
FIG. 3 is a top diagrammatic view of an astragal between the two door panels of the door system of FIGS. 1–2.

Turning to the Drawings wherein like numbers denote like components throughout the several views, in FIGS. 1–3, a closure system, depicted as a bi-parting horizontal sliding door system 10, advantageously includes fully resilient door panels 12, 14 for damage resistance that are affirmatively sealed to a doorframe 16 by an attraction sealing system, depicted as a magnetic sealing system 18, to effectively separate a warm space 20 from a cold space 22 (e.g., a cold storage locker). As shown particularly in FIG. 1, the door panels 12, 14 are supported by and power actuated by an overhead carriage 24, as is generally understood by those skilled in the art.

With particular reference to FIG. 2, the sliding door system 10 advantageously includes a frost control system 26 for preventing accumulation of ice on a sealing gasket 28 on the doorframe 16. Cold air from the cold space 22 passes through and is warmed by an air passage 30 that includes an air channel 32 in a periphery of each door panel 12, 14. In particular, the cold air is drawn through an intake manifold 34, which is encompassed and warmed by an upstream electric heater 36, into an air mover, depicted as a blower fan 38 driven by an electric motor 40. The upstream heater 36 provides dry, warm air to the blower fan 38, allowing the blower fan 38 to operate in an environment that promotes its reliability. Pressurized air from the blower fan 38 is then directed through an exhaust manifold 42, which is advantageously encompassed by a downstream electric heater 44 that further warms the air to a temperature sufficient to keep the sealing gasket 28 frost free, although it will be appreciated that one heater may be sufficient in some applications or that the heating is performed in the air mover.

With particular reference to FIG. 3, an astragal contact 46 between the right door panel 12 and the left door panel 14 is depicted. In the nearly closed position as depicted, a concave, vertical recess 48 of the left door panel 14 receives a vertical rounded end 50 of the right door panel 12. The recess 48 and rounded end are each encompassed by a covering 51 to thereby define vertical astragal air channels 52, 53 that are in communication respectively with a horizontal air channel 54 of the right door panel 12 and with a horizontal air channel 56 of the left door panel 14. Thereby, leading edges 58, 60 respectively of panels 12, 14 contact each other for a good sealing between the warm and cold spaces 20, 22 while also allowing sufficient airspace directing warmed air downward within recess 48 for air to downwardly move throughout both vertical astragal air channels 52, 53 to prevent frost accumulation at the astragal contact 46.

Figure 4:
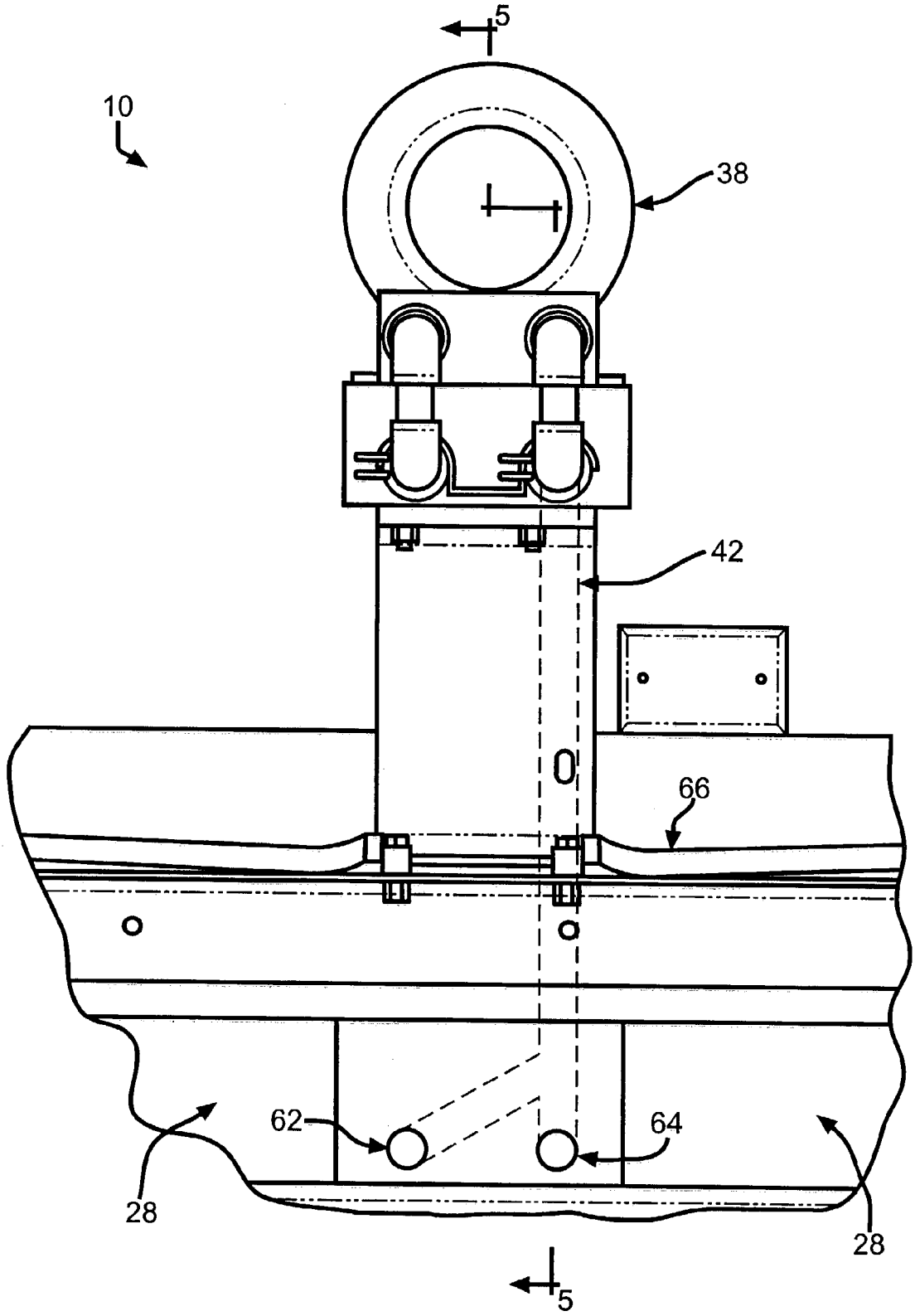
FIG. 4 is a front view of a doorframe-mounted portion of a frost control system of the door system of FIG. 1.

With particular reference to FIG. 4, the exhaust manifold 42 is shown separating into right and left outlet ports 62, 64 for directing warmed air to a respective door panel 12, 14 (not shown in FIG. 3). Also depicted is a down-and-in track 66 of the overhead carriage 24 that presents the door panels 12, 14 into compressive contact with the outlet ports 62, 64 and a horizontal gasket assembly 68 of the sealing gasket 28, yet avoid frictional wear as the door panels 12, 14 are positioned.

Figure 5:
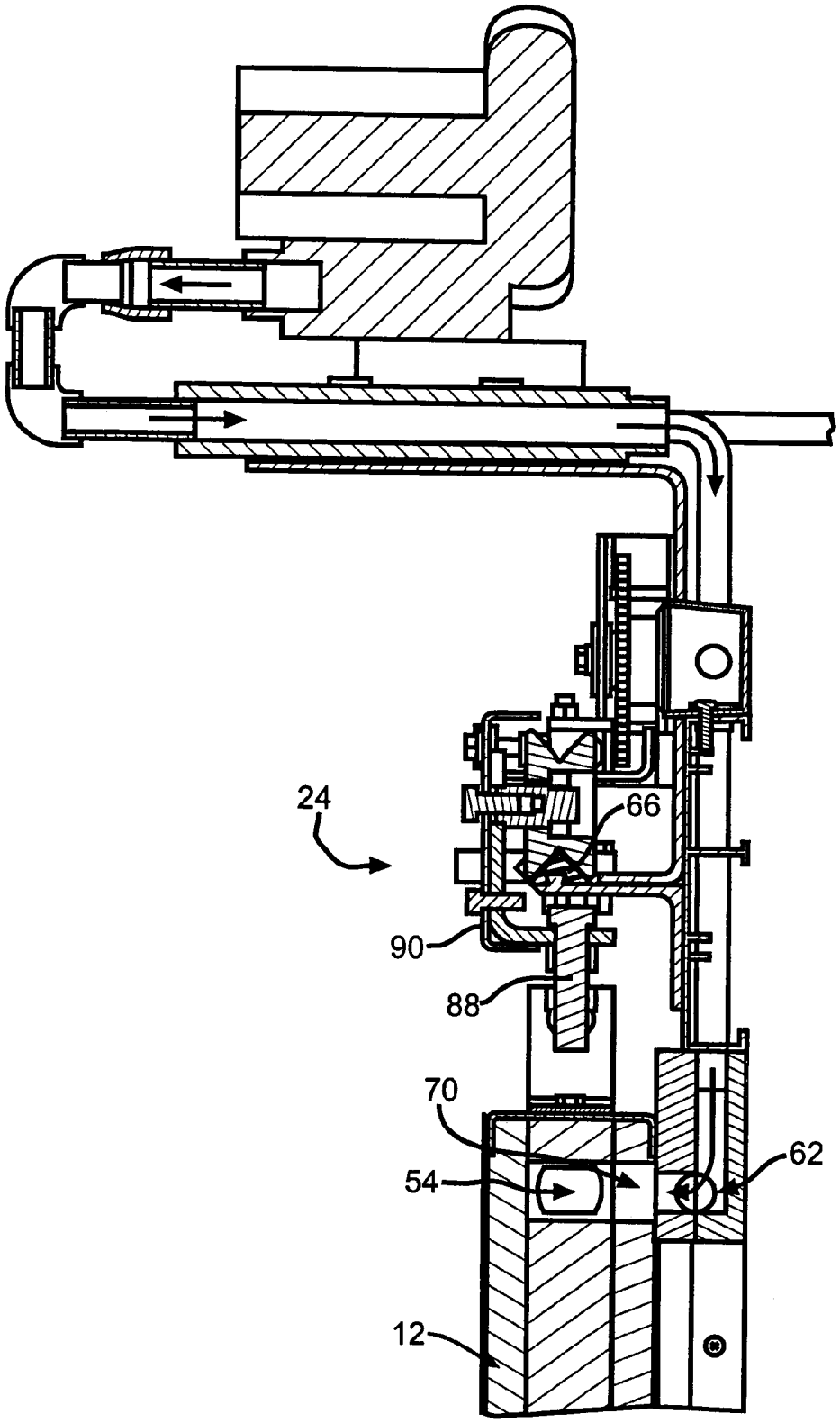
FIG. 5 is side cross sectional view along line 5—5 of FIG. 1 exposing an air passage of the frost control system passing through both the doorframe-mounted portion and a door panel.

In FIG. 5, the right outlet port 62 is depicted as positioned to communicate with the horizontal air channel 54 in the right door panel 12 via back face air passage 70. Also depicted in more detail is the overhead carriage 24.

Figure 6:
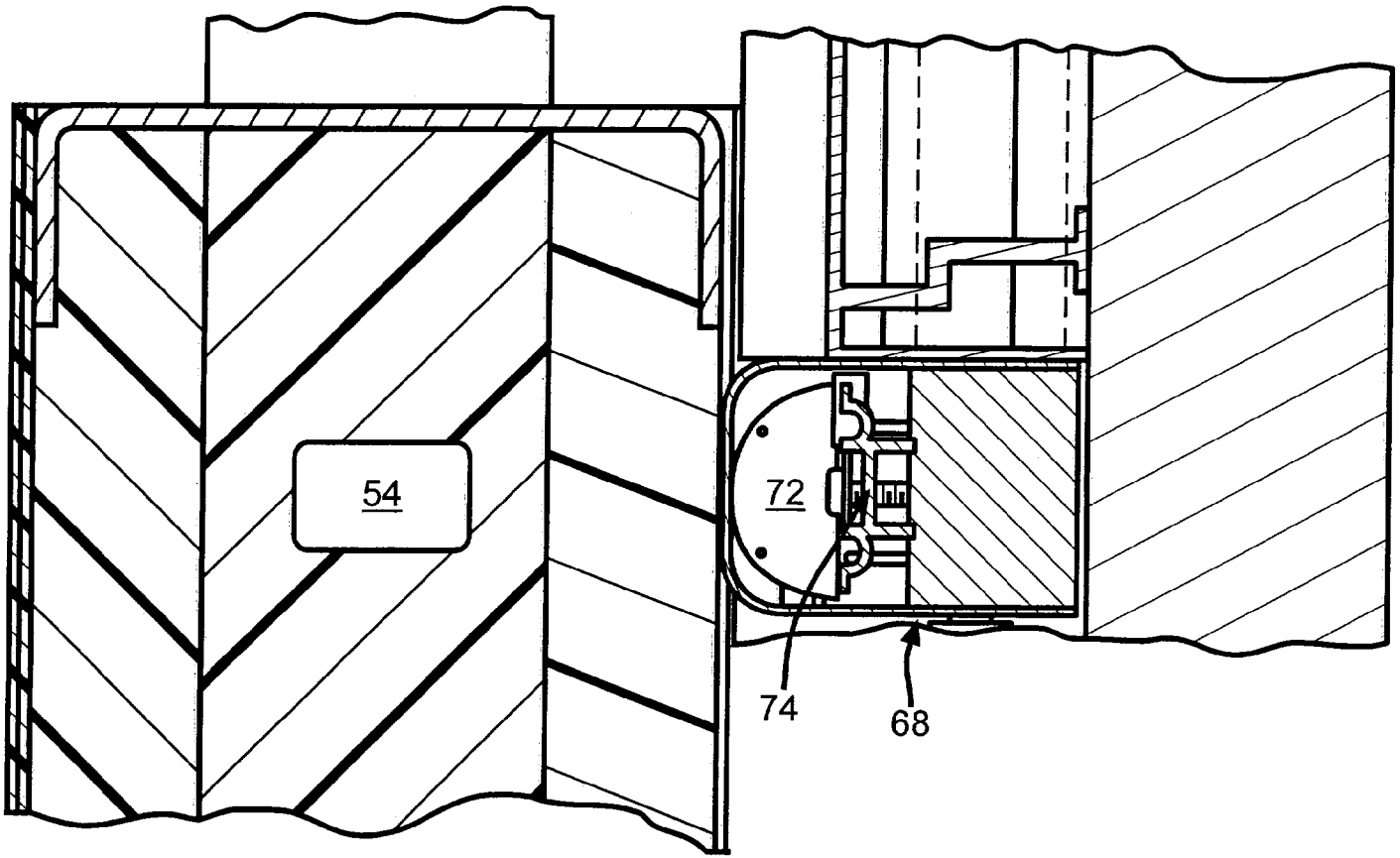
FIG. 6 is a cross sectional, detail view taken along line 6—6 of the air channel and gasket seal of the door system of FIG. 1.

In FIG. 6, the horizontal air channel 54 in the door panel 12 is shown proximate to the horizontal gasket assembly 68. In this illustrative version, the door panel 12 is compressed into the horizontal gasket assembly 68 without having to use magnetic attraction. Thus, the horizontal gasket assembly includes a resilient plug 72 between its over surface and a heated support structure 74.

Figure 7:
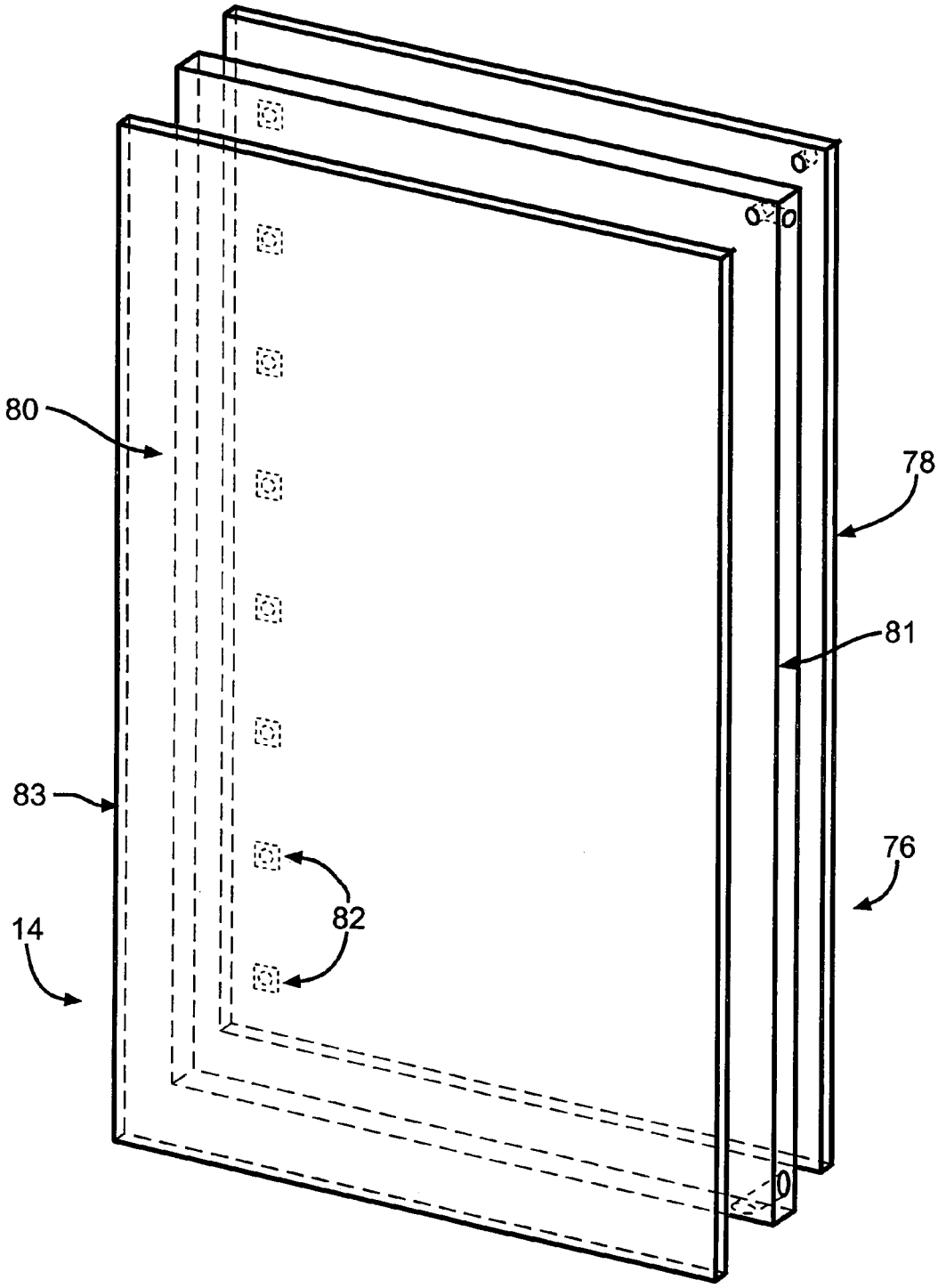
FIG. 7 is an exploded perspective view of a resilient, laminated door pad with a cover removed for the door system of FIG. 1.

In FIG. 7, the resilient portions of the door panel 14 are shown. In particular, a composite pad 76 is formed from two flexible neoprene sheets 78, 80, selected for a high degree of resilience for impacts, which are glued respectively to each side of a more rigid polyethylene slab 81, selected for holding the shape of the pad 76 and for receiving a drilled horizontal air channel 54 and routered vertical air channel (both not shown in FIG. 7) about its trailing edge 83. Permanent magnets 82 are embedded in the back neoprene sheet 78.

Alternatively, a composite pad (not shown) may be formed from a rigid material of polyurethane insulation, typically used in rigid door panels, in place of the polyethylene slab 81. Flexibility is achieved by dividing the urethane insulation into a plurality of mosaic, tile-like pieces. The pieces are held in place between the neoprene sheets 78, 80. The size of the pieces may advantageously be chosen for the desired degree of flexibility. For example, the tile size may be reduced at lower portions more prone to impact. Moreover, for a given thickness, the urethane has a higher insulation value than polyethylene. Thus, if more flexibility is desired, the thickness of the panel may be reduced without sacrificing insulation. Alternatively, the same thickness of the panel may be maintained with a realized increase in economic efficiency.

It will be appreciated that a number of materials may be used depending upon the degree of insulation, flexibility, thickness, cost, chemical environment, etc. Additional examples include a silicone sheet, a bead board, cross linked polyethylene, etc.

Figure 8:
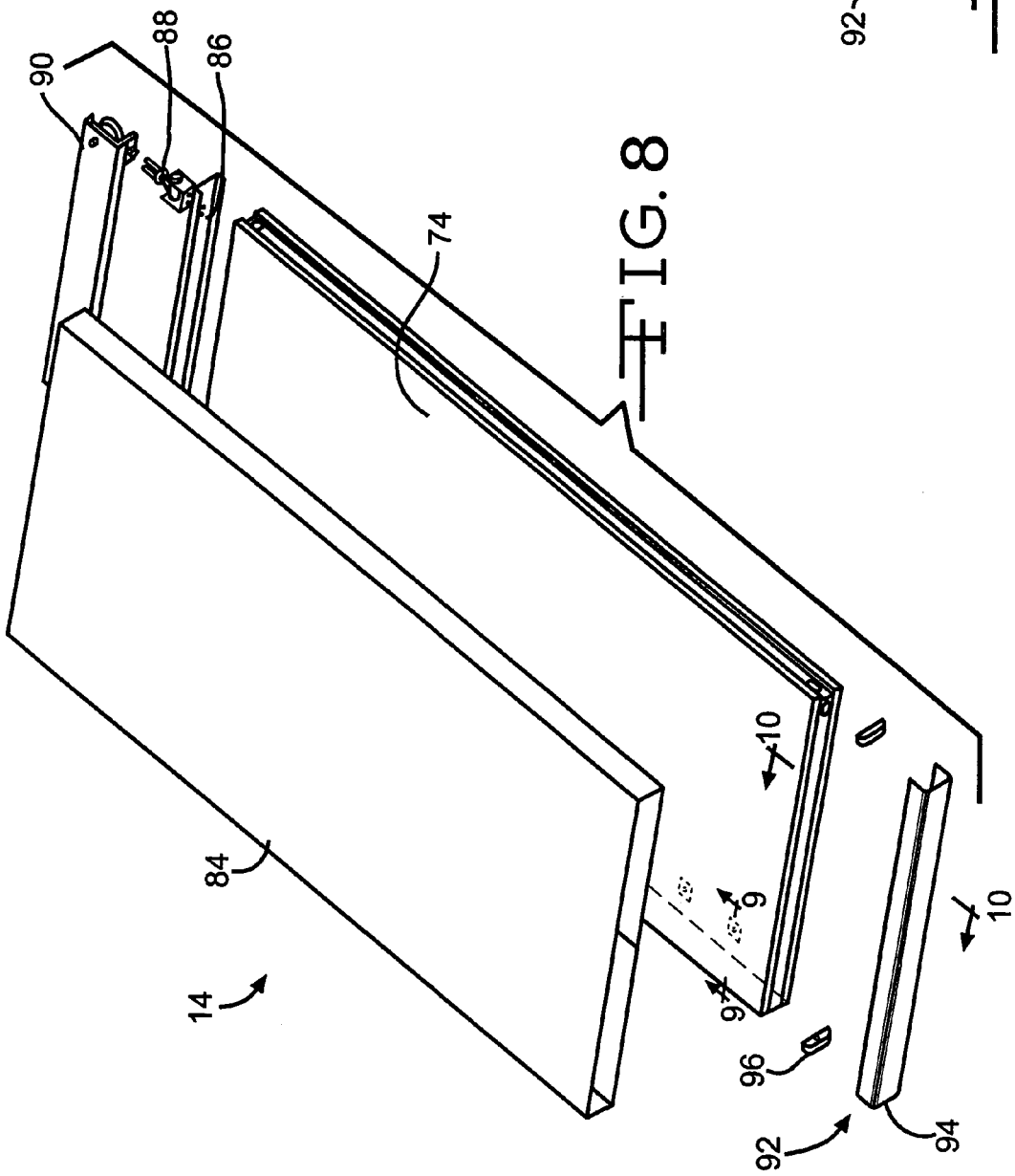
FIG. 8 is an exploded perspective view of the door panel of FIG. 1 including the resilient laminated door pad of FIG. 7.

In FIGS. 6 and 8, the assembled pad 74 is shown with a cover 84 of polyvinyl chloride (PVC) fabric that is glued over the pad 74. The assembly is attached with adhesive and mechanical fasteners to a structural member 86 across the top of the pad 74. Attachment members 88 spaced along the top of the structural member 86 are fastened to a roller assembly 90, which rides on the track 66 of the overhead carriage 24 (both the track 66 and the overhead carriage 24 are not shown in FIGS. 6 and 8 but are shown in FIG. 4).

Figure 9:
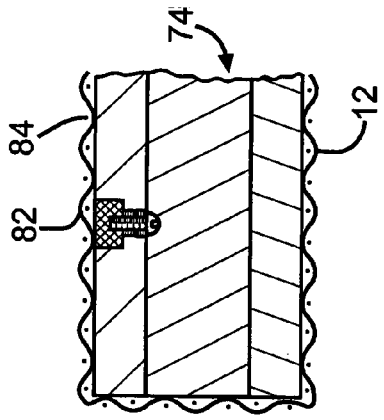
FIG. 9 is a cross sectional view along line 9—9 of a magnet embedded portion of the door panel of FIG. 8.

In FIG. 9, one permanent magnet 82 is shown embedded in an assembled panel 12.

Figure 10:
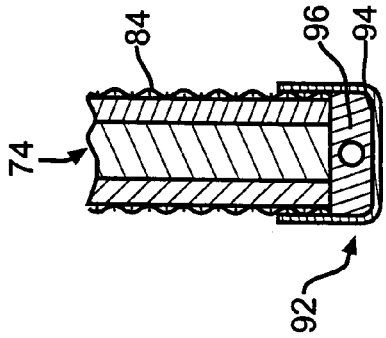
FIG. 10 is a cross sectional view along line 10—10 of a bottom edge air passage of a sill of the door panel of FIG. 8.

In FIGS. 8 and 10, a bottom sill 92 is shown wherein a bottom structural member 94 is affixed to the bottom of the pad 74. Perforated supports 96 space the pad 74 above the bottom structural member 94 and defines the bottom portion of the air channel 32 in the door panel 12.

Figure 11:
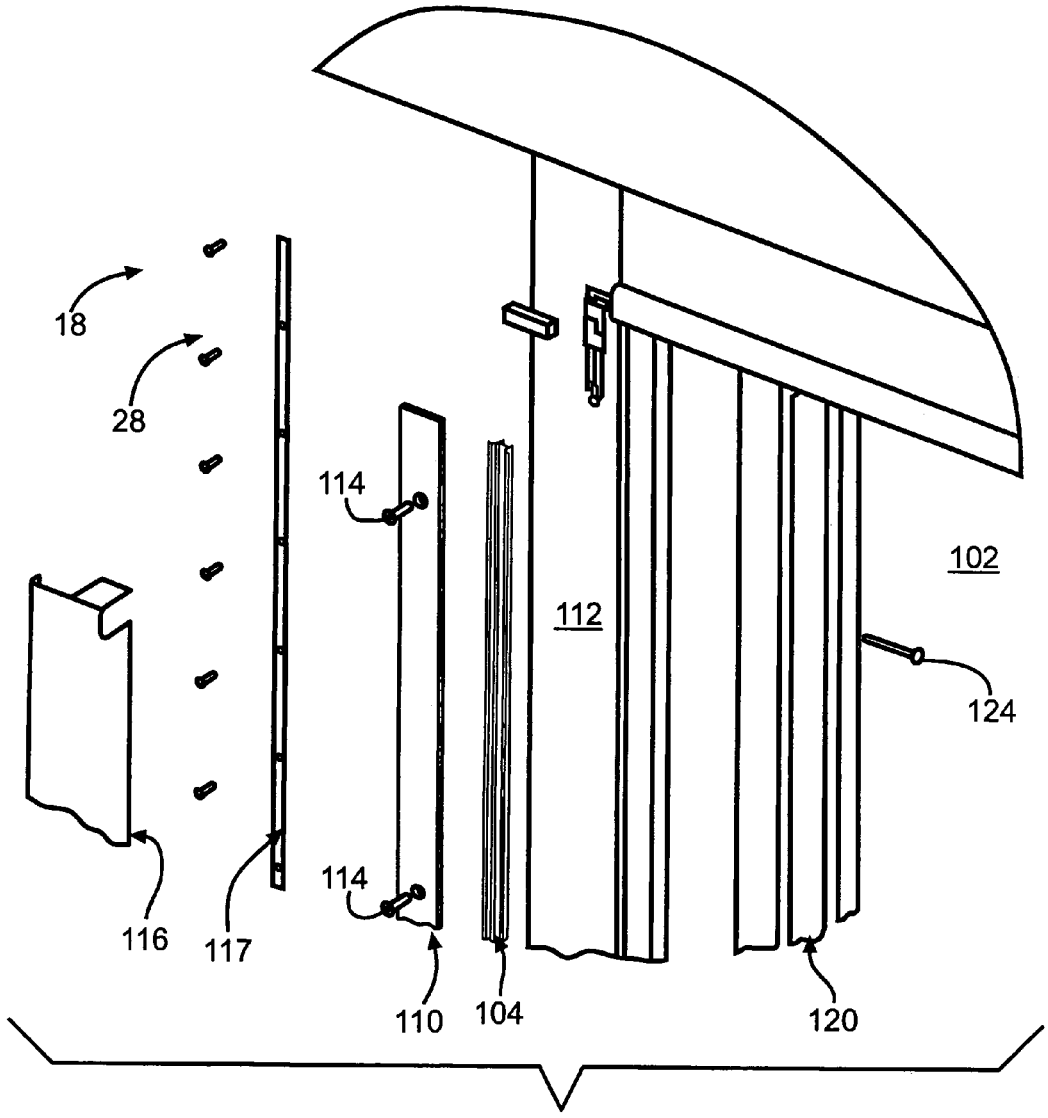
FIG. 11 is an exploded view of the door mounted gasket assembly of the door system of FIG. 1.
Figure 12:
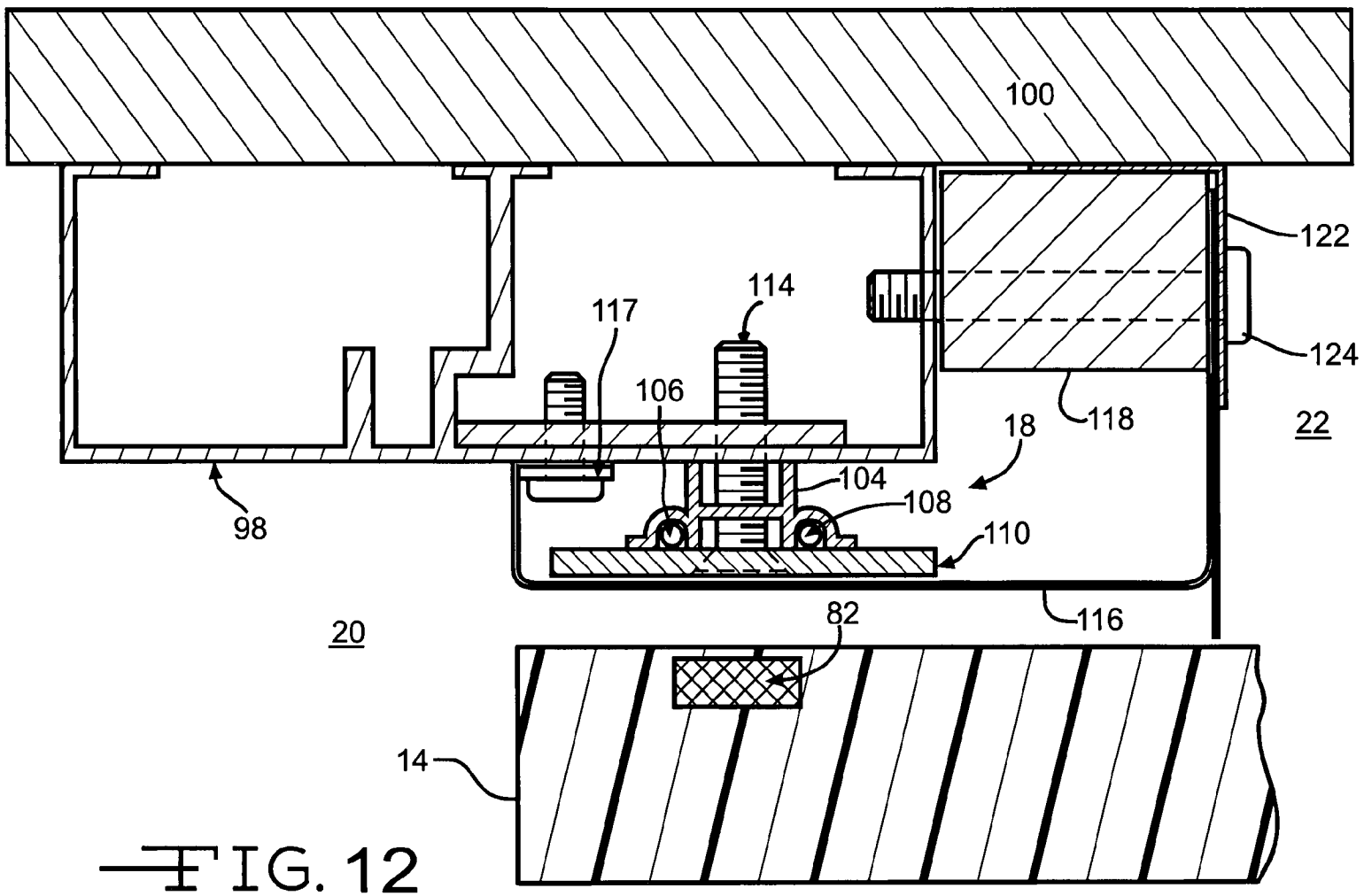
FIG. 12 is a horizontal cross sectional view along line 12—12 of FIG. 1 illustrating a passive gasket system of the door system.

In FIGS. 11–12, the magnetic sealing system 18 of the gasket seal 28 is shown in greater detail. A frame casing 98 is mounted to a front face of a wall 100 that defines a door opening 102. For instance, the casing 98 may comprise metal sheeting encasing a wood beam as is generally known. The wood may be replaced with another core material such as urethane to avoid problems associated with use of wood in a moist environment (e.g., swelling, bacteria growth, rotting). If plastics are used, the covering material may be adhered to the core material to minimize thermal distortion. This can be done by injecting the core material into a preformed cover or wrapping a cover of a preformed core and bonding it to the core. Advantageously, the casing 98 may comprise formed or extruded material (metal, plastic, fiber reinforced composites) as strength, stiffness or temperature conditions dictate.

An aluminum extruded guide 104 cradles two resistive electrical cables 106, 108 and is held in place between a ferrous strip 110 and a front surface 112 of the casing 98 by fasteners 114. A primary gasket 116 of PVC or other flexible reinforced fabric is bolted through a strip 117 to the front surface 112 and is wrapped over the ferrous strip 110 and a spacer block 118, over which a secondary gasket 120 is placed and held in place by an angled bracket 122. The secondary gasket 120 may alternatively be positioned outboard of the primary basket 116 as well as inboard at the door opening as depicted. Fasteners 124 pass through the bracket 122, secondary gasket 120, primary gasket 116, spacer block 118 to attach to an inner surface 126 of the casing 98. When the door panel 12 draws near its closed, blocking position, the magnets 82 draw the door panel 12 toward the ferrous strip 110

Figure 12A:
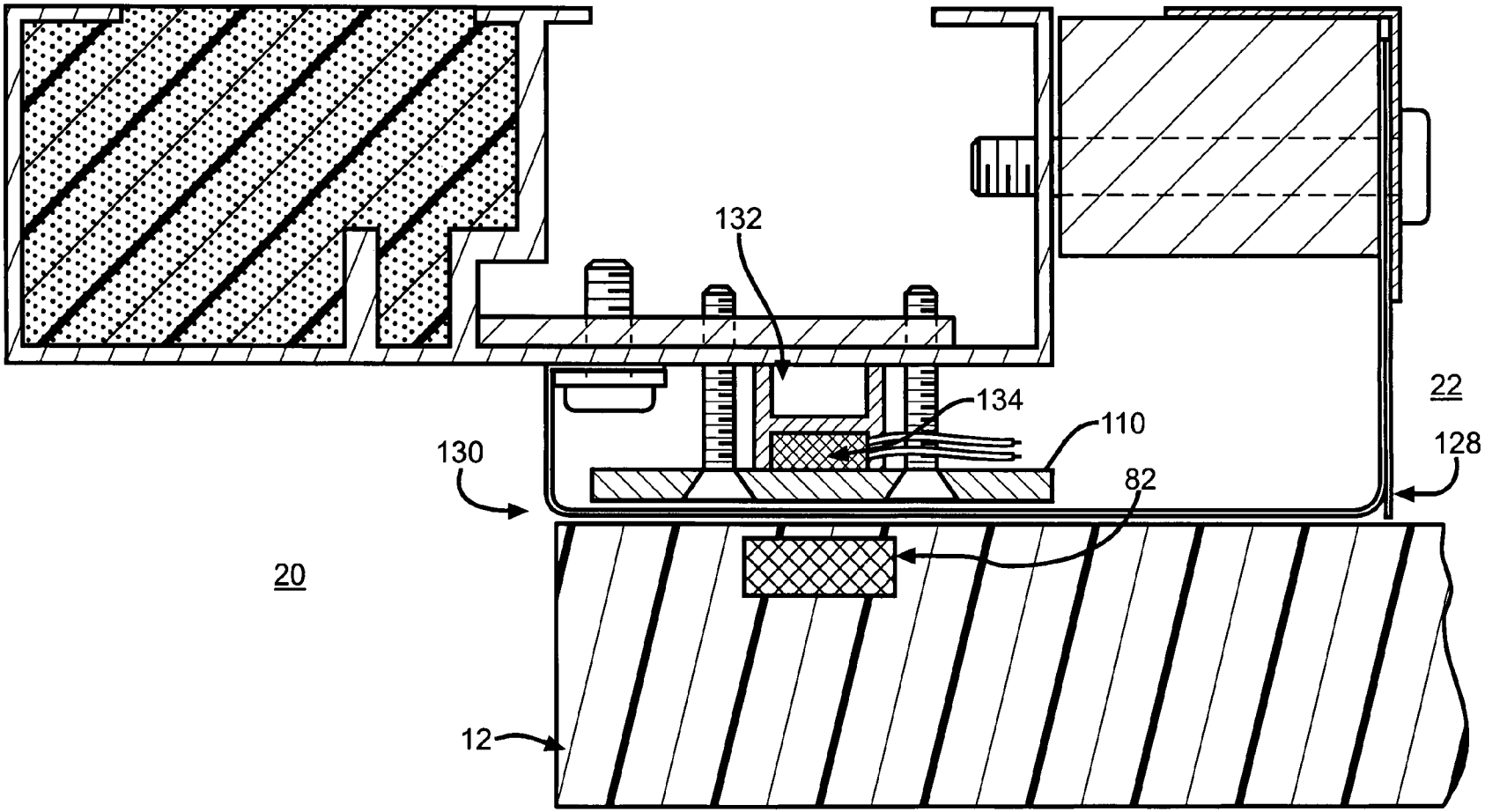
FIG. 12A is a horizontal cross sectional view along line 12—12 of FIG. 1 illustrating an alternative, active gasket system of the door system.

FIG. 12A depicts an active magnetic attraction system 128 that provides additional control features over the previously described passive magnetic attraction system 18. A gasket seal 130 that incorporates the active magnetic attraction system 128 is similar to that described for FIG. 12 with an electromagnet 134 mounted to a ferrous or non-ferrous strip 110. In the case of a non-ferrous strip, the door pad 12 tends to stay in place under the magnetic attraction between the permanent magnet 82 and the electromagnet 134. When opening the door panel 12, the electromagnet 134 may be advantageously polarized to the same magnetic pole as the adjacent face of the permanent magnet 82, thereby repulsing the door panel 12. The repulsion assists in overcoming any frost present and tends to hold the panel 12 away during movement to avoid frictional damage. The electromagnet 134 may assist in pulling the door close enough to the ferrous strip 110 that the permanent magnets 82 in the door will thereafter hold the door in place without the help of the electromagnet. When the door opens, the pole on the electromagnet 134 can be reversed to break the seal and make it easier for the door to open.

It will be appreciated that the door panel 12 may include a ferrous target (not shown) rather than a permanent magnet wherein the electromagnet 134 actively holds the door panel 12 closed and is deactivated when opening the door panel 12.

Figure 12B:
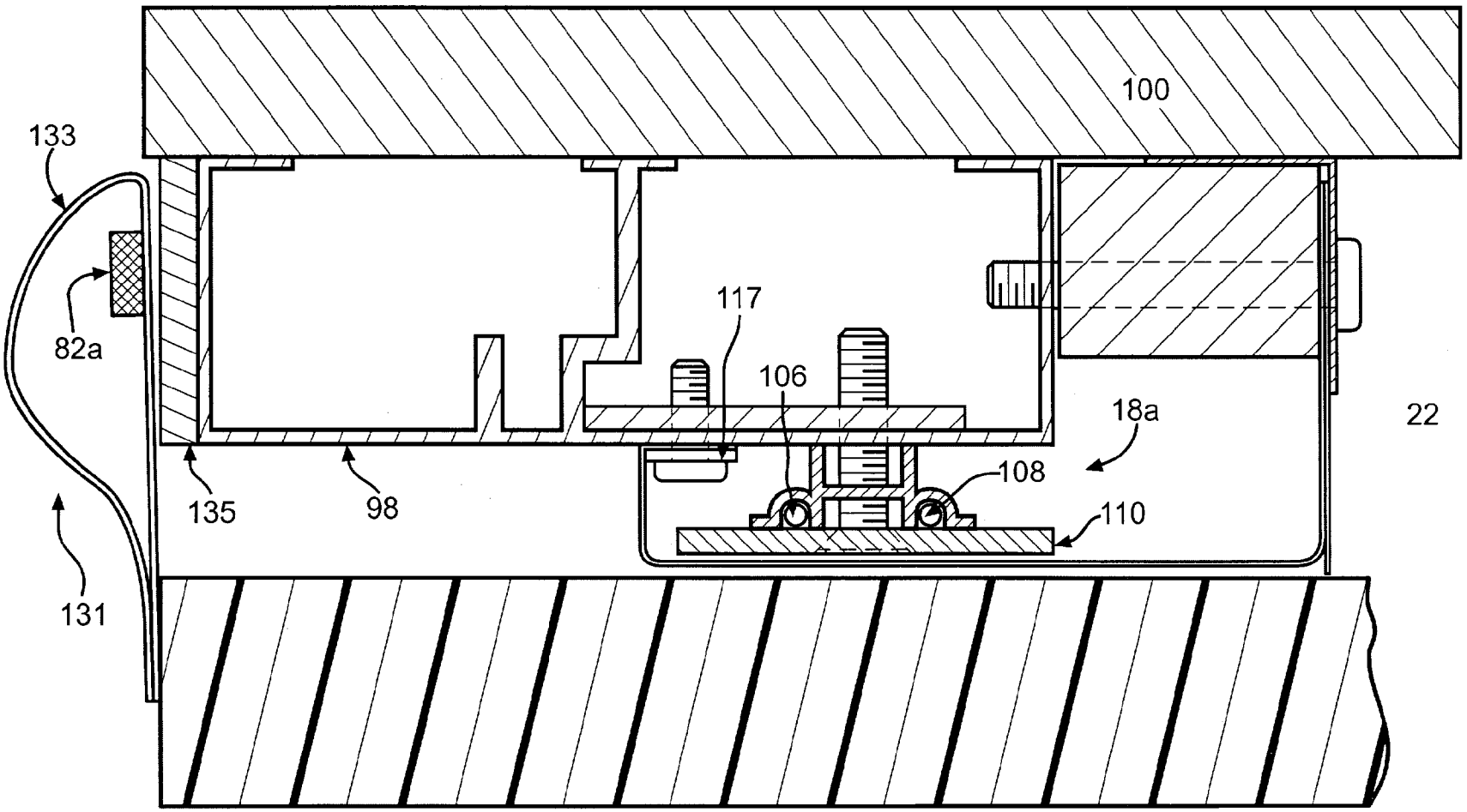
FIG. 12B is a horizontal cross sectional view along line 12—12 of FIG. 1 illustrating an alternative, loop gasket system of the door system.

FIG. 12B depicts a low-wear gasket system 18*a*, similar to the magnetic sealing system 18 of FIG. 12 except that the main gasket is no longer under pressure from a magnet assembly thereby eliminating a source of friction and wear to the door panel 14. Instead, the magnetic attraction feature has been provided separately as a rearwardly projecting, trailing edge magnetic flap 131 that acts as its own primary seal. A loop 133 of PVC fabric is attached along the full height of the trailing edge of the door panel 14 and is directed inwardly toward the wall 100. A small permanent magnet 82*a*, affixed to the inside of the loop 133, is registered to be attracted to a ferrous plate 135 attached to a vertical, outward edge of the frame casing 98. In addition to eliminating the frictional wear from the secondary gasket 120, this trailing edge magnetic flap 133 may accommodate a door panel 14 with additional flexibility and curve. Moreover, the permanent magnet 82*a* is advantageously small in that its amount of magnetic field strength need only be great enough to draw a rather light weight flap 133 into contact with the ferrous plate 135 rather than to draw the entire door panel 14 into contact.

Returning to FIG. 2, the operation of the door system 10 generally begins with the door panels 12, 14 closed as depicted, with permanent magnets 82 drawing the door panel 12 into contact with the gasket seal 28. A door controller 136 energizes resistive electrical cables 106, 108 in the gasket seal 28 to assist in frost control. The door controller 136 also energizes the motor 40 to turn the blower fan 38 to draw cold, dry air from the cold space 22 into the air passage 30. Specifically, in the intake manifold 34, the cold air is partially warmed by the upstream electrical heater 36 to keep the blower fan 38 and motor 40 in an optimum temperature range. Also, the pressurized air is further warmed by the downstream electric heater 44. The door controller 136 may closed-loop control the temperature of the warmed air with a temperature sensor 138, such as depicted in the intake manifold 34. It will be appreciated that one or more sensor may be used to optimize the temperature in various regions of the air passage 30. The warmed air is passed through the outlet port 62 into the air channel 32 in the door panel 12. The warmed air passes through the astragal passage air channel 52 along leading edge 58 of door panel 12 and around the periphery of the door panel 12 proximate to the gasket seal 28 and thereafter is vented into the warm space 20. The door controller 136 may condition activation of the frost control system 26 on confirming that the door panel 12 is closed, as sensed by a switch 140.

In response to user actuation of an opening device, depicted as a door pull rope switch 142, the door controller 136 deactivates the frost control system 26 and may activate the electromagnet 134 (if present) (not shown in FIG. 2) to repulse the door panel 12. The door controller 136 then actuates a door motor 144, such as a two-speed, three phase electric brake motor, that is coupled to the door panel 12. It will be appreciated that a single speed motor with a variable frequency drive may be used as another alternative. Once opened, the door controller 136 awaits until user actuation of the door pull rope switch 142 to close the door panel 12. The door controller 136 may monitor a sensed pneumatic pressure on one or both leading edges 58 to reverse or stop the door motor 144 as a safety feature. The door controller 136 may also monitor stalling of the door motor 144 indicative of system failure or other blockage, such as by monitoring motor current "I" with a current sensor 146. It will be appreciated that due to the flexible nature of the door panel 12, monitoring of motor current may be sufficient without a pneumatic sensor on the leading edge.

Figure 13:
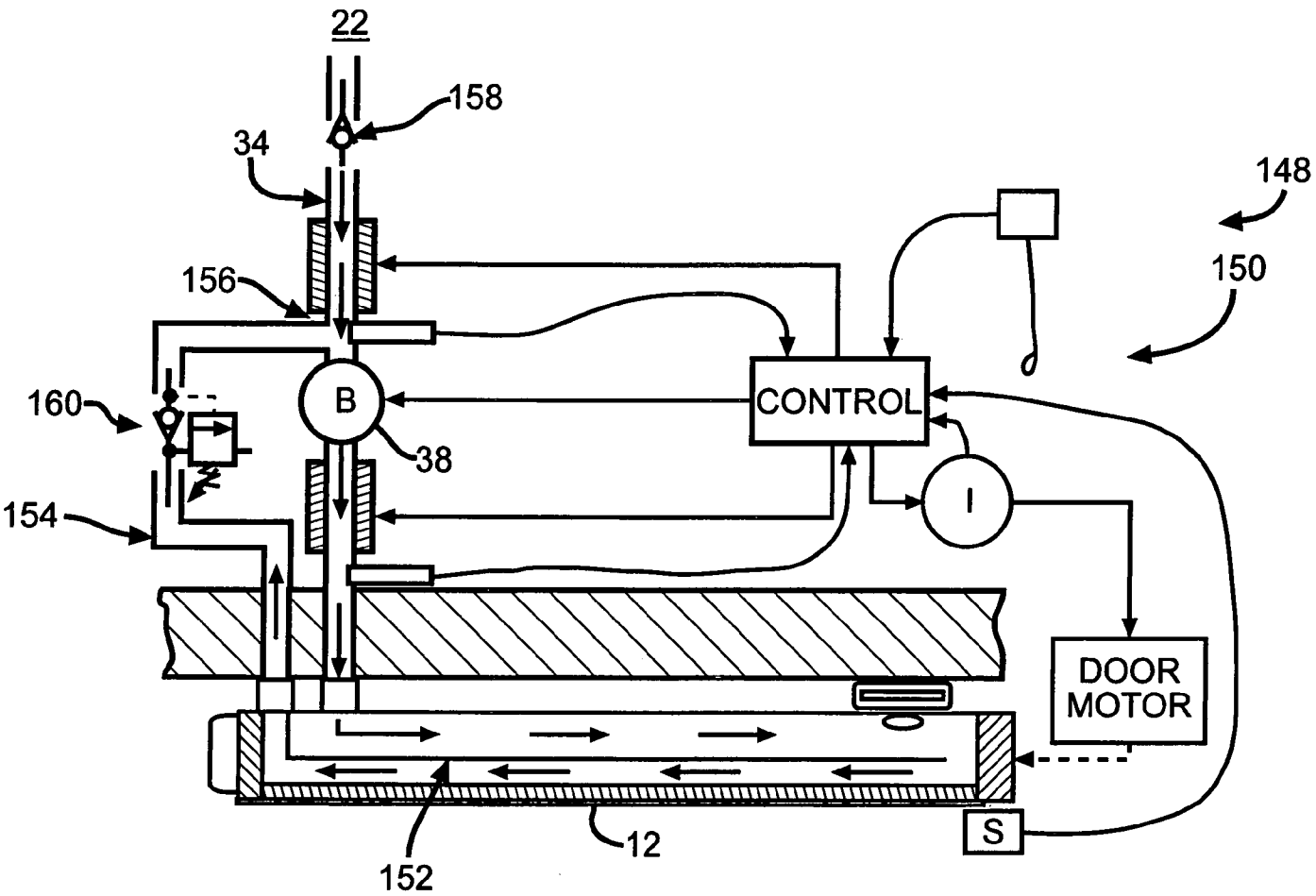
FIG. 13 is a diagrammatic view of an alternative frost control system including recycled warmed air for the door system of FIG. 1.

In FIG. 13, an alternative door system 148 illustrates additional features that may be incorporated into a pressurized frost control system 150. Recycling the pressurized air rather than venting the air into the warm space 20 may advantageously reduce the amount of electrical power required to keep the door panel 12 warm. Another advantage or use would be to air stiffen the door panel 12 by inflating air tubes 152 in the door panel 12.

Air recycling is shown with a return passage 154 from the door panel 12 to an upstream intake 156 of the blower fan 38. A check valve 158 may be included in the intake manifold 34 to prevent inadvertent porting of return air into the cold space 22. In addition, a pressure relief check valve 160 may advantageously be included in the return passage 154 to prevent damage to the door panel 12 such as during an impact.

Figure 14:
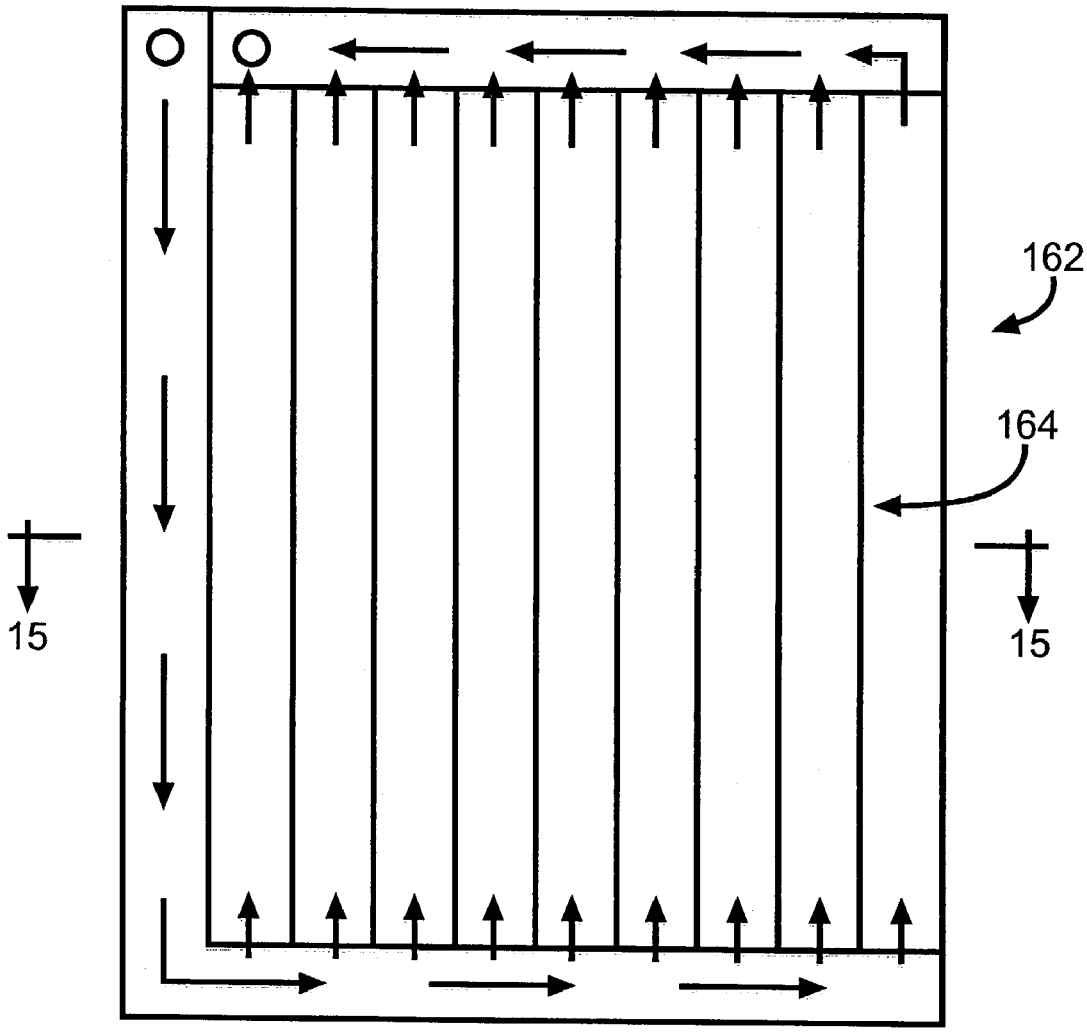
FIG. 14 is a diagrammatic view of an alternative air-stiffened door panel for the door system of FIG. 1.
Figure 15:
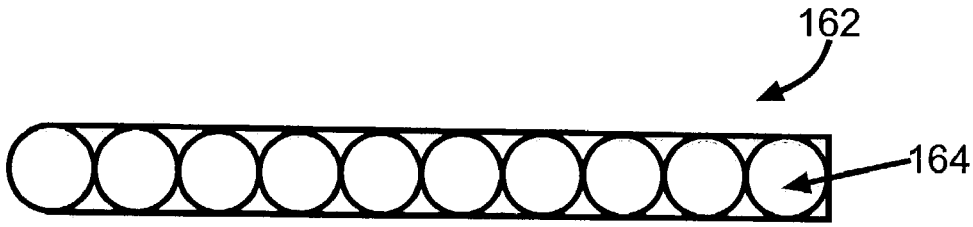
FIG. 15 is a horizontal cross sectional view of the door panel of FIG. 14.
Figure 16:
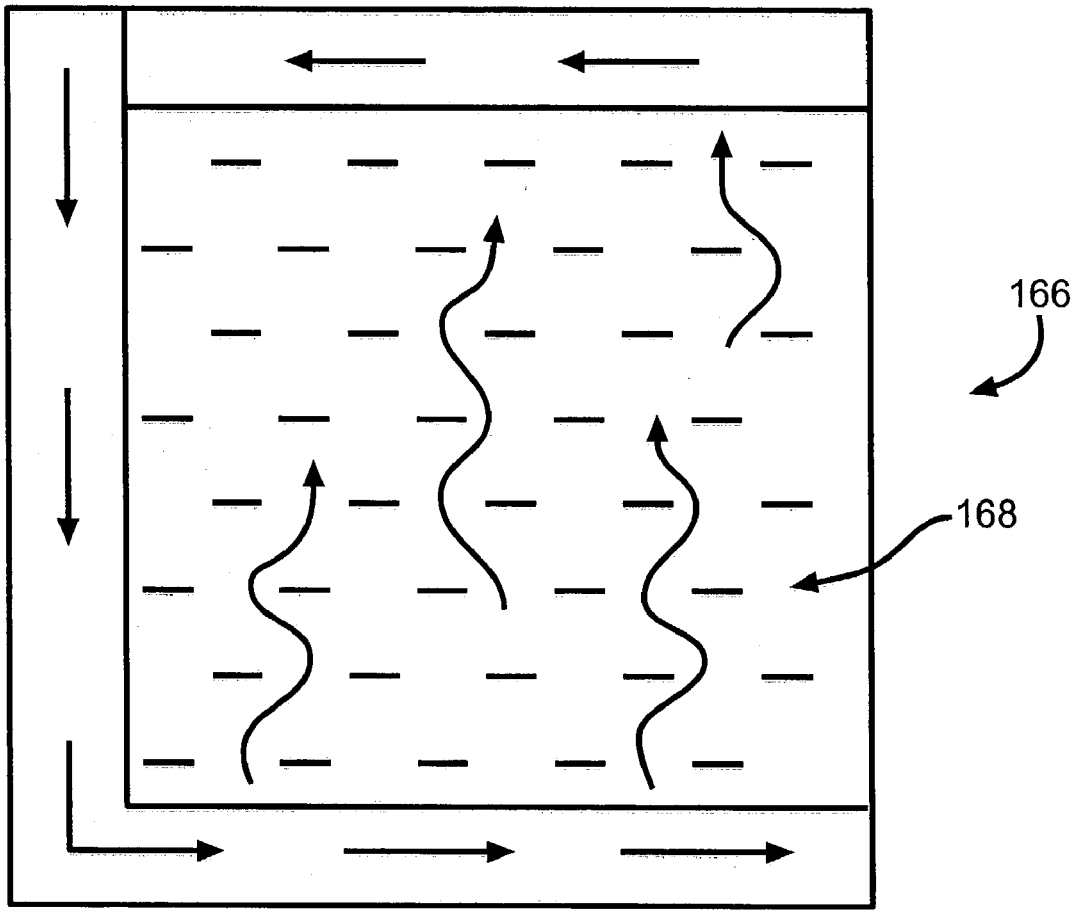
FIG. 16 is a further alternative air stiffened door panel for the door system of FIG. 1.

In FIGS. 14–15, an air-stiffened door panel 162 is depicted wherein the warmest air is first directed around the periphery for gasket warming purposes and also allowed to pressurize vertical air tubes 164. In FIG. 16, an alternative air-stiffen door panel 166 includes a porous or quilted central portion 168 that is pressurized.

Figure 17:
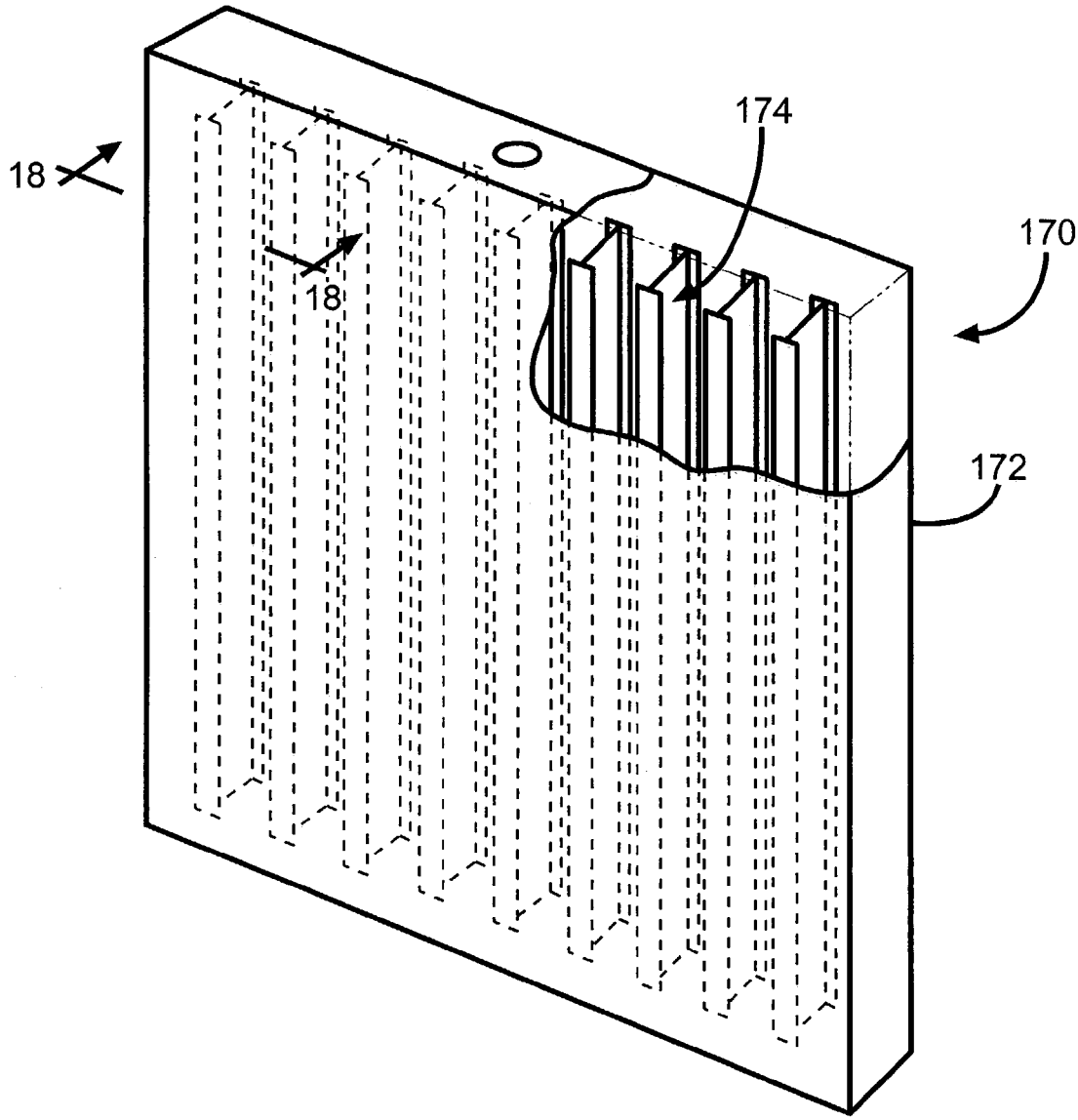
FIG. 17 is a perspective, partially cutaway view of an alternative bagged, poured foam door panel for the door system of FIG. 1.
Figure 18:
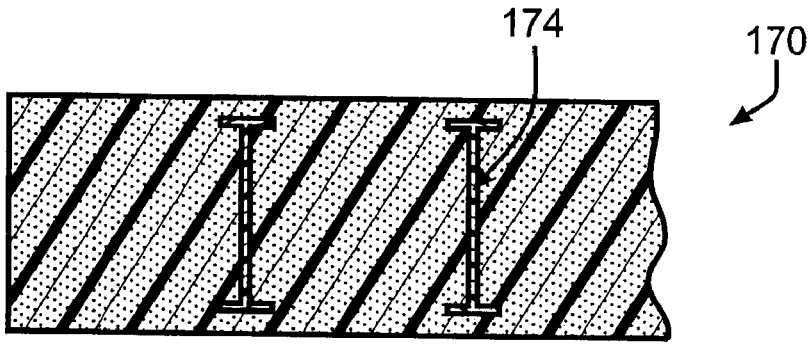
FIG. 18 is a horizontal cross sectional view of the bagged, poured foam door panel of FIG. 17.
Figure 19:
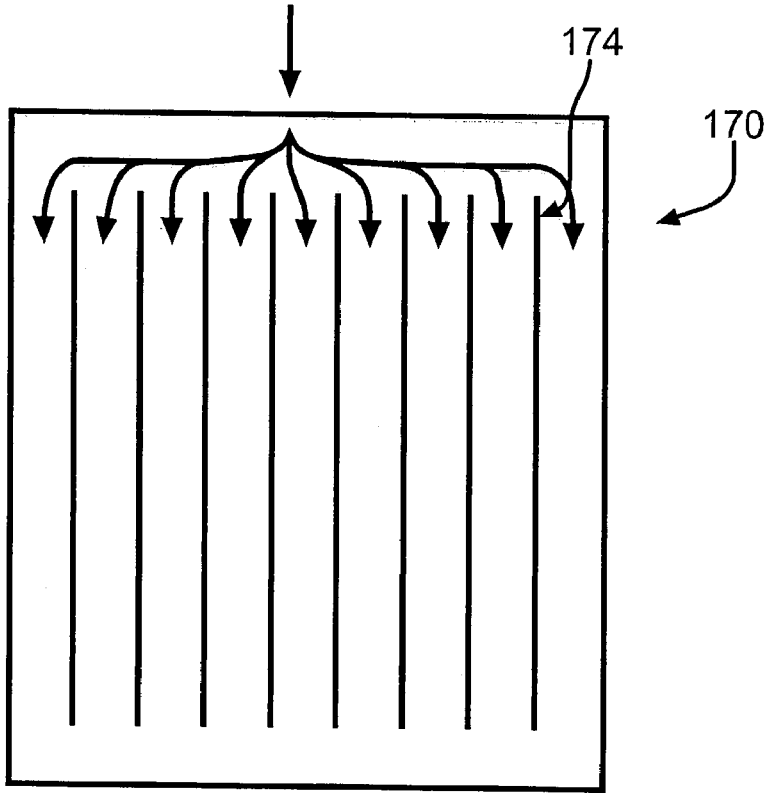
FIG. 19 is front diagrammatic view of the door panel of FIG. 17 being filled with poured foam.

In FIGS. 17–19, a bagged, poured foam door panel 170 is depicted as an alternative to glued foam laminate construction. A bag cover 172 includes a plurality of vertical dividers constructed of a material similar to the bag 174 that control the flow of uncured foam so that the resulting door panel 170 has the desired shape. Thereby, use of a large fixture may not required. Moreover, large shipping containers may be avoided by shipping an unfilled bag cover 172 with a supply of uncured foam (not shown) that is used on location. Features such as permanent magnets (not shown) may be affixed to the bag cover 172.

Figure 20:
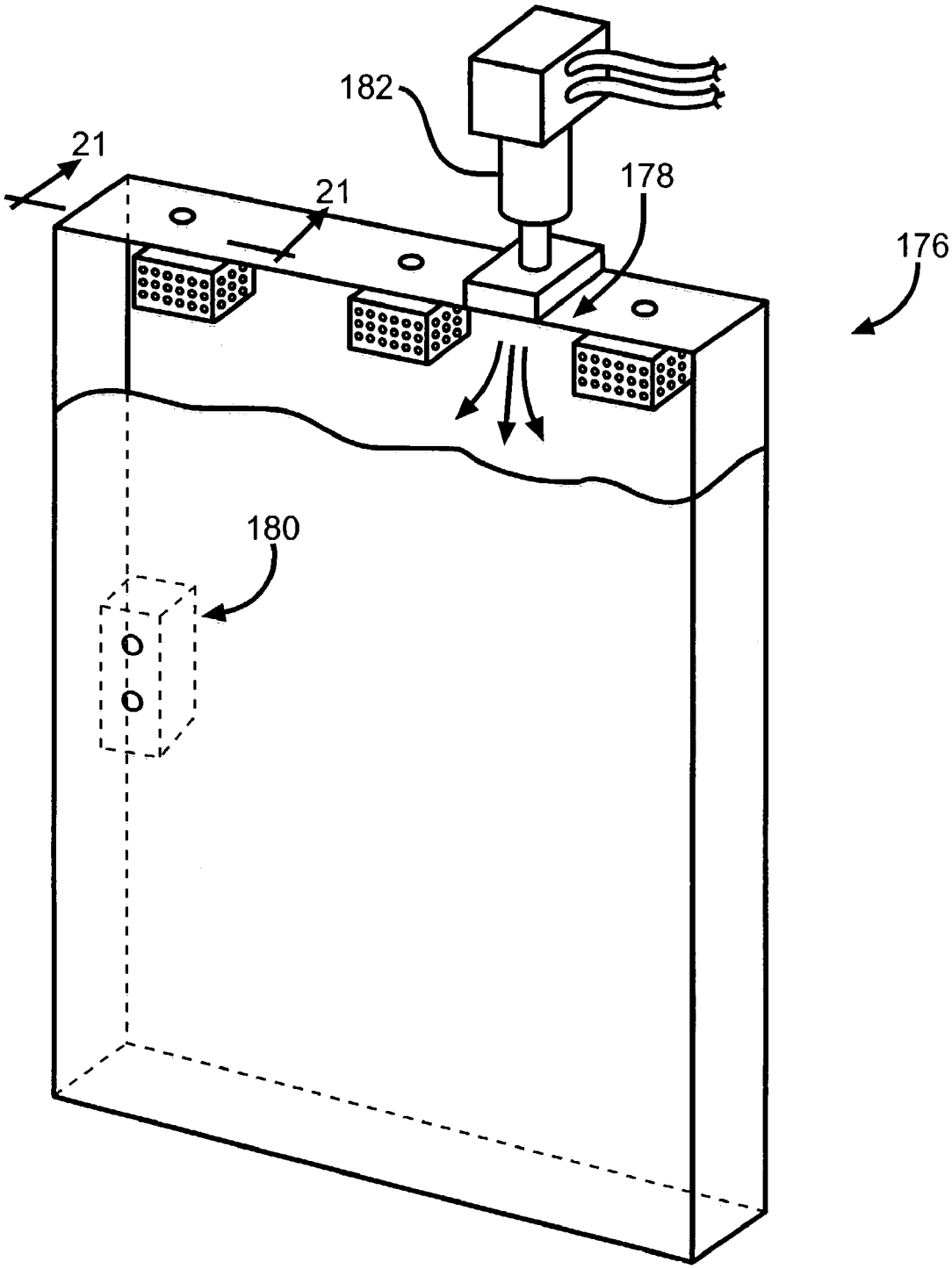
FIG. 20 is a perspective, partially cutaway view of a further alternative fixture for forming an unbagged, poured foam door panel for the door system of FIG. 1.
Figure 21:
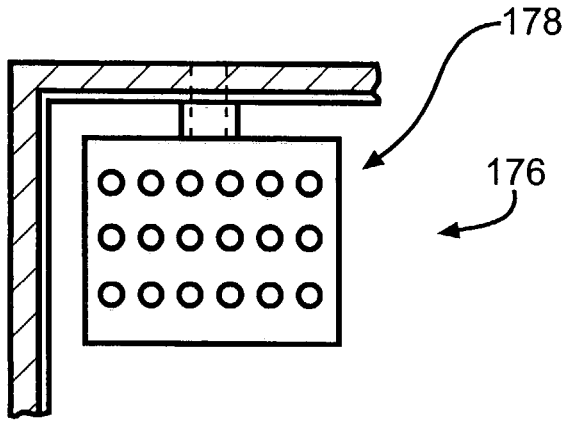
FIG. 21 is a front cross sectional view along line 21—21 of the fixture and foam attachment device of FIG. 19.
Figure 22:
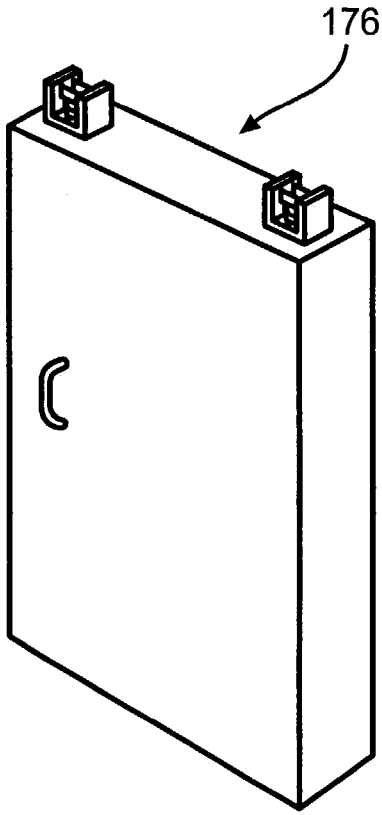
FIG. 22 is a perspective view of a completed self-skinning door panel formed in the fixture of FIG. 19.

In FIGS. 20–22, an unbagged, poured foam door panel 176 that may have advantages in reducing cost of manufacturer by eliminating the bag cover. A fixture (not shown) positions hanger structures 178 and other door hardware 180 until injected foam 182 cures onto these elements, the hanger structures 178 may be of various forms that facilitate a large surface area attachment to the foam with horizontal protrusions to resist pull-out, for instance, a "tree root" like structure, perforated plate, or simple bar with cross pieces etc. A self-skinning flexible foam advantageously attaches to the hanger structures 178 and forms a wear resistant surface without the additional manufacturing step of attaching a cover.

Figure 23A:
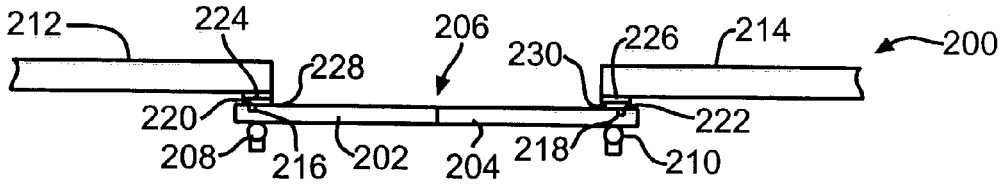
FIGS. 23A–F are top view diagrams of a damage resistant door system incorporating an auto-reset feature.

FIGS. 23A–F depict operation of an auto-reset feature of a damage resistant door system 200 that may advantageously be incorporated into applications that are automatically actuated. In FIG. 23A, the door system 200 is depicted in its normal, closed position with left pad 202 abutting right pad 204, thereby closing a door opening 206. The distal lower portions of the left and right pads 202, 204 are each inwardly held by left and right restraining devices 208, 210 against left and right doorframes 212, 214, respectively, forming a seal against corresponding left and right gaskets 216, 218.

In the illustrative embodiment, the restraining devices 208, 210 are rollers but could be any device protruding upwards on the front side of the panels 202, 204. These restraining devices 208, 210 may be attached to the floor or to the door casing. In the latter configuration, the restraining device may require that a bracket go under the door to hold the restraining device. It should be appreciated that the left and right restraining devices 208, 210 may have application in manually opened door systems as well as automatically opened door systems, especially when significant air pressure differential exist at times across the door opening or when the door pads 202, 204 are sufficiently flexible as to needing an urging at their lower portions to seal against the doorframe 212, 214. In some applications, the normal travel of the door panels 202, 204 may maintain the respective restraining device 208, 210 in contact, avoiding any damage when the leading edge of the door panels 202, 204 encounters the restraining device 208, 210 when closing. In other applications, the door panels 202, 204 at their most open position are not in contact with the restraining devices 208, 210. Thus, guides (not shown) may inwardly direct the leading edge of the door panels 202, 204 to counter any outward deflection of the lower portion of the door panel 202, 204.

Although the restraining devices 208, 210 advantageously assists in sealing the flexible door panels 202, 204, mitigating damage from impacts is enhanced by having the restraining devices 208, 210 sufficiently low as to allow an outwardly forced door panels to pop over the restraining device 208, 210. Sufficient lateral travel in the overhead carriage (not shown in FIG. 23A) thus allows the door to be reinserted between the restraining devices 208, 210 and doorframe 212, 214 when cycled fully open and then closed.

In some applications it is advantageous to retain a normal operation wherein the door remains at all times in contact with the restraining device 208, 210, avoiding impacts to the leading edge, while also providing for the resetting after the door panel 202, 204 is forced outward during an impact. Moreover, it is a further advantage for the door to begin to open when a forklift impacts the door panel 202, 204 to thereby minimize the amount of deflection required for the vehicle to pass through.

To that end, a capability for sensing that the door panels 202, 204 have achieved a fully closed position with an effective seal is provided by left and right sensors, depicted as left and right magnetic field transducers 220, 222 (e.g., Hall effect transducers) that sense the proximity respectively of left and right magnets 216, 218 in respective pads 202, 204. Signal lines 224, 226 to each transducer 220, 222 respectively communicate to a control system (not shown) that respond to the sensed position. It will be appreciated that sensing the magnets 216, 218 takes advantage of magnets that also assist in sealing the door panel 202, 204 to the doorframe 212, 214. However, other types of sensors may be used, such as mechanical limit switches, optical sensors, etc.

Figure 23B:
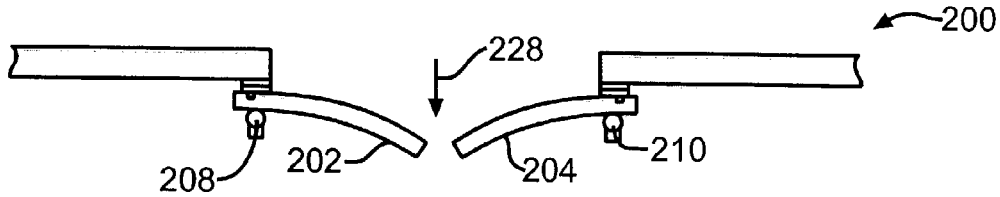

In FIG. 23B, an impact is illustrated at arrow 228 as coming inside the cold storage space, forcing the door pads 202, 204 outward. The selection and placement of sensors 220, 222 may advantageously detect impacts from both directions. For instance, an impact from either direction may tend to draw the lower, trailing edge of the door pad 202, 204 upward and inward, which may detected by various proximity sensors. Alternatively, the impact from either direction may pull the lower, trailer edge of the door pad 202, 204 completely out from the doorframe 212, 214 and restraining device 208, 210, which may be detected by a limit switch. As yet a further alternative, multiple sensors on each side may be used to detect impact from either direction.

Figure 23C:
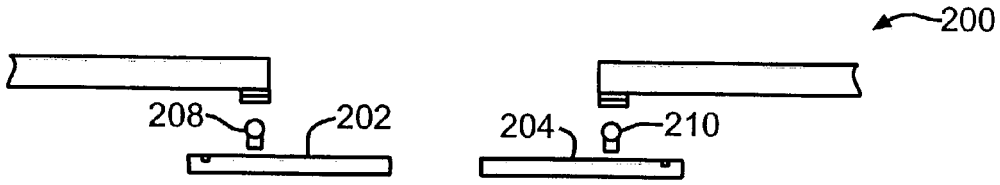

In FIG. 23C, the impact has caused each door pad 202, 204 to ride over the respective restraining device 208, 210. Also, the door system 200 has responded to the sensed impact by beginning to auto-set by opening the door pads 202, 204.

Figure 23D:
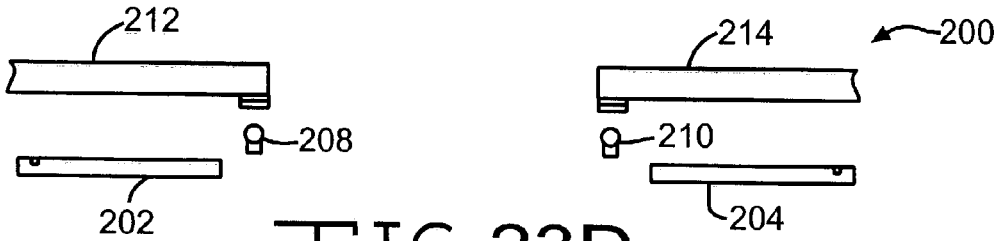

In FIG. 23D, the door pads 202, 204 have been drawn to a fully open position, wherein the leading edges are beyond the respective restraining devices 208, 210. The pads 202, 204 are thereafter maintained in this position for a period of time or until sensed as having swung back toward the doorframe 212, 214 under the influence of gravity, as depicted in FIG. 23E.

Figure 23E:
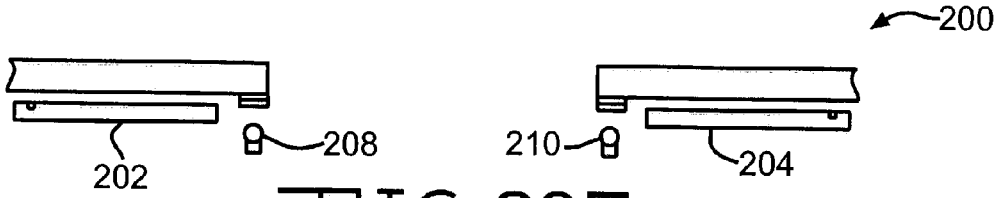
Figure 23F:
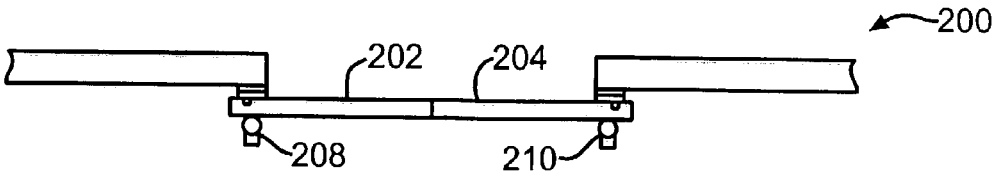

In FIG. 23E, the door system 200 has closed the pads 202, 204, completing the auto-reset back to the condition that existed prior to the impact. It will be appreciated that closing may be contingent upon a timer typically sufficient for any impacting vehicle to have left the door opening 206. Alternatively or in addition, automatic closing during auto-reset may be contingent upon sensing an unimpeded door opening, such as by an unblocked optical beam across the door opening 206.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art.

For example, while air warming of the entire periphery of a door panel may be advantageous, in some applications only one, two or three edges may be warmed. For instance, a upper edge and a trailing edge may rely solely on electrical warming in the doorframe as sufficient, whereas the leading edge and bottom edge are internally warmed by air.

While a magnetic attraction is depicted and described for advantageously compressively sealing the door panel to the doorframe, it will be appreciated that other approaches may be employed to attract the door panel to the doorframe. For example, pneumatic suction may created about the doorframe that is presented to pull in the periphery of the door panel.

While air warming of the door panel has been advantageously depicted, it should be appreciated that other warming techniques may be employed that do not rely upon electrical wiring in the door panel. For example, inductive targets may be embedded or affixed to the periphery of a door panel. A radiated electromagnetic signal from the doorframe may then be used to inductively couple power into the inductive targets to cause resistive heating in the door panel.

Air stiffening of the door panel 12 may also be provided separate from a frost control system. For example, separate air tubes dedicated for use as air stiffening bladders may be pressurized and left pressurized rather than recycling the air for heating.

Synergy exists between using these aspects of the invention together in a door system for a cold storage locker; however, it will be appreciated that aspects of the present invention may be used separate and apart from the other features. For instance, separating environments may be very desirable for soundproofing or preventing airborne particulates from passing through the doorway. Another example is coolers that are maintained above freezing. Consequently, the effective sealing of the door panel by attraction may be employed without the need for a frost control system. As a further example, the configuration of how the door panels is positioned may provide sufficient affirmative urging into sealing contact with the doorframe that an attraction capability is not required, although the elimination of frost at the sealing contact may still be desired.

It will be appreciated that aspects of the present invention have application to door systems that fold individual panels in an according fashion in order to require less lateral travel when opened. Furthermore, aspects of the present invention have application to door systems that are not supported from an overhead track.

In the illustrative embodiment of FIGS. 23A–F, the door system 200 includes both restraining devices 208, 210 and door position sensors 220, 222 that may be used in an auto-resetting feature. Although a door closed and sealed sensing capability is disclosed in combination with a physical restraining capability, it will be appreciated that door-positioning sensing has applications without the physical restraining capability. For instance, a failure indication may be given to operators when a situation is detected where the door should have achieved full travel yet a seal is not achieved. Furthermore, automatic opening of the door upon impact may advantageously reduce damage to the door system even if restraining devices are not present.

What is claimed is:

1. A closure system for comprising:

a doorframe mounted in a wall and defining an entry between a cold space on one side of the wall and a warm space on the other side of the wall;

a movable door panel having a periphery and selectably disposable against the doorframe to at least partially block the entry when in a closed position, the door panel substantially unobstructing the entry when in an open position;

a sealing member positioned between and attached to a selected one of the doorframe and the door panel periphery and operatively configured to form an air seal with the other of the doorframe and the door panel periphery when the door panel is in the closed position; and a frost control system to prevent ice forming on the sealing member, comprising:

an air passage communicating between the cold space and a doorframe port attached to the doorframe proximate to the periphery of the movable door panel when in the closed position, an air heater in the air passage to warm air from the cold space; and an air channel defined internal to the movable door panel proximate to the periphery and including an inlet port communicating with the doorframe port to receive warmed air therefrom;

an air mover in communication with the air passage to move the warmed air through the air passage to the air channel of the door panel.

2. The closure system of claim 1, wherein the air heater is positioned upstream of the air mover in the air passage toward the cold space for maintaining the air mover within an optimum temperature range.

3. The closure system of claim 2, further comprising a door position sensor, wherein the air heater further comprises a temperature controller that is responsive to the door position sensor to activate the air heater.

4. The closure system of claim 2, wherein the air heater further comprises:

a temperature sensor positioned to sense a temperature of the air in the air passage; and a controller responsive to the sensed air temperature from the temperature sensor to selectively activate the air heater.

5. The closure system of claim 2, wherein the air heater further comprises:

a downstream air heater downstream of the air mover.

6. The closure system of claim 1, wherein the movable door panel comprises at least two leaves engageable at an astragal interface, the air channel including a branch traversing the astragal interface.

7. The closure system of claim 6, wherein the astragal interface is defined by a concave recess along a length of one of the at least two leaves with outer edges in close proximity to the other of the at lest two leaves.

8. The closure system of claim 2, further comprising:

a ferrous target attached to the doorframe;

a door track mounted across a top portion of the doorframe;

said door panel movably and vertically supported by the door track, and comprised of a resilient material including a flexible rearward face;

a door positioning system operable to position the door panel between said open position and said closed position, the flexible rearward face of the door panel having a periphery aligned to the ferrous target of the doorframe when the door panel is in the closed position;

a magnet attached to the periphery of the rearward face of the door panel positioned to draw the flexible rearward face into sealing contact with the doorframe when the door panel is in said closed position.

9. The closure system of claim 8, wherein the frost control system directs the warmed air proximate to the sealing contact.

10. The closure system of claim 9, wherein the air channel comprises air passages in the door panel configured to receive the warmed air and to direct the warmed air to the periphery of the door panel.

11. The closure system of claim 10, wherein the door panel comprises at least two leaves engageable at an astragal interface, the air passages including a branch traversing the astragal interface.

12. The closure system of claim 10, wherein the frost control system further comprises:

a temperature sensor positioned to sense a temperature of the warmed air in the air passage;

said air mover moving the air from the cold space through the air passages to the sealing contact between the door panel and the doorframe; and a temperature controller responsive to the temperature sensor and configured to activate the air heater and the air mover.

13. The closure system of claim 10, wherein the frost control system further comprises an electrical heater in the doorframe proximate to the sealing contact.

14. The closure system of claim 8, further comprising a door sensor operable to sense a condition of the door panel being blocked, the door positioning system being responsive to the door sensor to discontinue moving the door panel in the direction of the blockage.

15. The closure system of claim 1, wherein the air passage communicates with the cold space at an intake, an exit port in the door panel communicating with an intake to the frost control system to recycle the warmed air.

16. The closure system of claim 1, further comprising a magnetic assembly having a first member installed in the doorframe and a second member installed in a rear facing portion of the door panel, wherein first and second members magnetically attract each other when the door panel is in the closed position and thereby maintain the door panel into proximity with the doorframe.

17. The closure system of claim 16, wherein the first member comprises an electromagnet and the second member comprises a permanent magnet, the magnetic assembly further comprising a door controller responsive to a user command to open the door panel and to deactivate the electromagnet.

18. The closure system of claim 16, wherein the first member comprises an electromagnet and the second member comprises a ferrous target, the magnetic assembly further comprising a door controller responsive to a user command to open the door panel and to deactivate the electromagnet.

19. The closure system of claim 16, wherein the first and second members of the magnetic assembly comprise a ferrous target and a permanent magnet respectively.

20. The closure system of claim 16, further comprising a rearwardly projecting flap attached to a trailing edge of the door panel and including the second member.

21. The closure system of claim 1, further comprising:

a door track mounted across a top portion of the doorframe;

a door position sensor operable to sense the door panel in the closed position with the periphery of the door panel proximate to the doorframe; and a door positioning system operably configured to position the door panel to the closed position and to reset the door panel to the open position in response to the door position sensor.

22. The closure system of claim 21, further comprising a restraining device positioned to urge a lower portion of the door panel into contact with the doorframe.

23. The closure system of claim 22, wherein the door track includes a lateral extension sufficient for the door panel to open beyond contact with the restraining device, and wherein the door positioning system is further operably configured to move the door panel by opening the door panel beyond contact with the restraining device and thereafter closing the door panel.

24. The closure system of claim 23, wherein the door positioning system is further operably configured to open the door panel in response to a user command to the open position wherein the door panel remains in contact with the restraining device.

25. The closure system of claim 23, wherein the door positioning system is further operably configured to wait for a period of time with the door panel opened beyond contact with the restraining device.

* * * * *

UNITED STATES PATENT AND TRADEMARK OFFICE

CERTIFICATE OF CORRECTION

PATENT NO. : 6,983,565 B2 
DATED : January 10, 2006
INVENTOR(S) : Curtis L. Berry and William B. Nichols It is certified that error appears in the above-identified patent and that said Letters Patent is hereby corrected as shown below:

Column 11,
Line 11, "A closure system for comprising" should be -- A closure system comprising --.
Line 67, "of the at lest two leaves" should be -- of the at least two leaves --.

Signed and Sealed this

Thirteenth Day of June, 2006

JON W. DUDAS
*Director of the United States Patent and Trademark Office*